US008506034B2

(12) United States Patent
Usuda et al.

(10) Patent No.: US 8,506,034 B2
(45) Date of Patent: Aug. 13, 2013

(54) PRINTING APPARATUS

(75) Inventors: Hidenori Usuda, Matsumoto (JP); Shinichi Kamoshida, Shiojiri (JP); Mitsuaki Yoshizawa, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 405 days.

(21) Appl. No.: 12/730,143

(22) Filed: Mar. 23, 2010

(65) Prior Publication Data

US 2010/0245440 A1 Sep. 30, 2010

(30) Foreign Application Priority Data

Mar. 24, 2009 (JP) ..... 2009-072467
Dec. 14, 2009 (JP) ..... 2009-283271

(51) Int. Cl.
*B41J 29/38* (2006.01)

(52) U.S. Cl.
USPC ..... 347/14

(58) Field of Classification Search
None
See application file for complete search history.

(56) References Cited

U.S. PATENT DOCUMENTS 5,946,011 A 8/1999 Kanaya
6,147,140 A 11/2000 Jaeger et al.
6,322,197 B1 * 11/2001 Yanaka ..... 347/41
7,537,331 B2 * 5/2009 Akase et al. ..... 347/101
2004/0042047 A1 3/2004 Kawatoko et al.
2006/0192800 A1 * 8/2006 Kato et al. ..... 347/9
2007/0046725 A1 * 3/2007 Hoshiyama et al. ..... 347/40
2009/0295856 A1 * 12/2009 Yoshida ..... 347/16

FOREIGN PATENT DOCUMENTS

DE 10 2005 006 092 A 8/2005
EP 0 267 566 B1 9/1994
EP 0 685 341 A 12/1995
EP 685341 A1 * 12/1995
JP 10-323978 A 12/1998

* cited by examiner

*Primary Examiner* — Stephen Meier
*Assistant Examiner* — Tracey McMillion
(74) *Attorney, Agent, or Firm* — Kilpatrick Townsend & Stockton LLP

(57) ABSTRACT

Provided is a printing apparatus for printing an image on a medium, which is transported in a transport direction, by forming dots by ejecting ink from a plurality of nozzles while moving the nozzles in an intersecting direction that intersects the transport direction. The printing apparatus has a first printing mode for printing a mirror image of a predetermined image as the image on the medium and a second printing mode for printing a positive image of a predetermined image as the image on the medium, the medium being a transparent medium. The first printing mode is different from the second printing mode in at least one of a transportation operation of transporting the medium and a dot-forming operation of forming the dots by ejecting ink while moving the nozzles.

5 Claims, 21 Drawing Sheets

FIG. 18

| PRINTING TYPE | RESOLUTION (dpi) | FEED PAPER | OVERLAP | PRINTING DIRECTION |
|---|---|---|---|---|
| 1 | 1440 × 720 | INTERLACE | YES | Uni-d |
| 2 | 720 × 720 | INTERLACE | YES | Bi-d |
| 3 | 720 × 360 | PSEUDO BAND | NO | Uni-d |
| 4 | 720 × 360 | PSEUDO BAND | NO | Bi-d |
| 5 | 360 × 360 | BAND | NO | Uni-d |

FIG. 21

| SURFACE PRINTING MODE | | | | | BACKSIDE PRINTING MODE | | | | |
|---|---|---|---|---|---|---|---|---|---|
| PRINTING TYPE | RESOLUTION (dpi) | FEED PAPER | OVERLAP | PRINTING DIRECTION | PRINTING TYPE | RESOLUTION (dpi) | FEED PAPER | OVERLAP | PRINTING DIRECTION |
| 1 | 1440 X 720 | INTERLACE | YES | Uni-d | 1 | 1440 X 720 | INTERLACE | YES | Bi-d |
| 2 | 720 X 720 | INTERLACE | YES | Bi-d | 2 | 720 X 720 | INTERLACE | NO | Bi-d |
| 3 | 720 X 360 | PSEUDO BAND | NO | Uni-d | 3 | 720 X 360 | PSEUDO BAND | NO | Bi-d |
| 4 | 720 X 360 | PSEUDO BAND | NO | Bi-d | 4 | 360 X 360 | BAND | NO | Bi-d |
| 5 | 360 X 360 | BAND | NO | Bi-d | 5 | 180 X 180 | BAND | NO | Bi-d |

PRINTING APPARATUS

This application claims priority to Japanese Patent Application No. 2009-072467, filed Mar. 24, 2009 and Japanese Patent Application No. 2009-273271, filed Dec. 14, 2009. The entireties of both of these applications are incorporated by reference herein.

BACKGROUND

1. Technical Field

The present invention relates to a printing apparatus.

2. Related Art

As a printing apparatus that prints an image on a medium, an ink jet printer is known, which prints the image on a medium, which is being transported in a transport direction, by forming dots by ejecting ink from a plurality of nozzles while moving the nozzles in a direction intersecting the transport direction (e.g., JP-A-10-323978). The ink jet printer forms the image by forming a plurality of dot lines, of which dots formed by ink ejected from the nozzles, are lined up in the intersecting direction due to the movement of the nozzles in the intersecting direction, so as to be lined up in the transport direction by the transportation of the medium.

The ink jet printer has a problem in that a difference in the ink-ejecting characteristics of the respective nozzles or a difference in dot lines formed by different movement operations of the nozzles may cause the image to have stripe patterns in the intersecting direction due to, for example, color unevenness. The stripe patterns are apt to occur in a type of printing mode in which the image is printed at a high speed, and are more easily seen when the surface of the image is coarse.

SUMMARY

An advantage of some aspects of the invention is to provide a printing apparatus that can print an image more rapidly so that stripe patterns caused by unevenness or the like are not easily seen.

The printing apparatus according to an exemplary embodiment of the invention is for printing an image on a medium, which is transported in a transport direction, by forming dots by ejecting ink from a plurality of nozzles while moving the nozzles in an intersecting direction that intersects the transport direction. The printing apparatus has a first printing mode for printing a mirror image of a predetermined image as the image on the medium and a second printing mode for printing a positive image of a predetermined image as the image on the medium, the medium being a transparent medium. The first printing mode is different from the second printing mode in at least one of a transportation operation of transporting the medium and a dot-forming operation of forming the dots by ejecting ink while moving the nozzles.

The other features of the present invention will be more apparent from the description of the specification taken in conjunction with the accompanying drawings.

BRIEF DESCRIPTION OF THE DRAWINGS

The invention will be described with reference to the accompanying drawings, wherein like numbers reference like elements.

FIG. 18 is a view showing an example of printing mode set in a fourth exemplary embodiment of the invention.

FIG. 21 is a view showing an example of printing mode set in a fifth exemplary embodiment of the invention.

DESCRIPTION OF EXEMPLARY EMBODIMENTS

Figure 1:
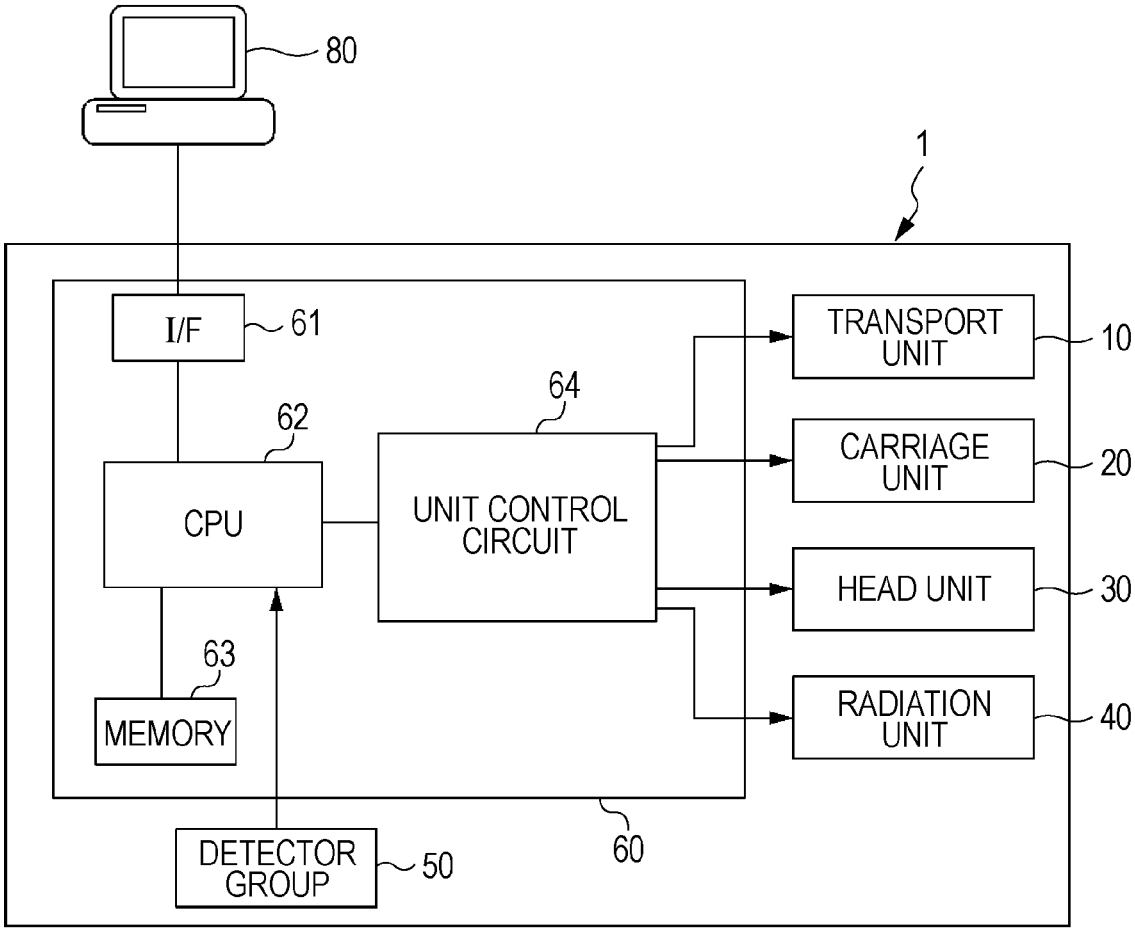
FIG. 1 is a block diagram showing the configuration of a printing system and a printer according to an exemplary embodiment of the invention.

The following features will be more apparent from the description of the specification taken in conjunction with the accompanying drawings.

The printing apparatus according to an exemplary embodiment of the invention is for printing an image on a medium, which is transported in a transport direction, by forming dots by ejecting ink from a plurality of nozzles while moving the nozzles in an intersecting direction that intersects the transport direction. The printing apparatus has a first printing mode for printing a mirror image of a predetermined image as the image on the medium and a second printing mode for printing a positive image of a predetermined image as the image on the medium, the medium being a transparent medium. The first printing mode is different from the second printing mode in at least one of a transportation operation of transporting the medium and a dot-forming operation of forming the dots by ejecting ink while moving the nozzles.

According to the printing apparatus, the first printing mode for printing the mirror image on the transparent medium and the second printing mode for printing the positive image on the medium are different in at least one of the transportation operation of transporting the medium and the dot-forming operation of forming the dots by ejecting ink while moving the nozzles. It is possible to print the mirror image on the transparent medium or print the positive image on the medium by the proper transportation operation and the proper dot-forming operation. Therefore, the image can be printed rapidly both in the case of printing the mirror image on the transparent medium and in the case of printing the positive image on the medium since stripe patterns caused by stains or the like are easily seen.

The fact that the first printing mode and the second printing mode are different in at least one of the transportation operation and the dot-forming operation means that the transportation operations are different in the amount of transporting the medium or transportation timing or the dot-forming operations are different in the direction of moving the nozzles when ejecting ink or in ink-ejecting timing when the same image is printed in the first printing mode and in the second printing mode. Accordingly, this does not include the case of printing different images in which ink is ejected onto different positions of the medium to form dots.

In addition, examples of the transparent medium include not only a completely colorless and transparent medium but also a high-transparency film in which, for example, an image can be seen through the medium.

In the printing apparatus, the dot-forming operation of the second printing mode may move the nozzles by more passes than the dot-forming operation of the first printing mode in order to form one dot line in which the dots are arranged in the intersecting direction to form the image.

When the image printed on the medium such as paper is seen from the printed surface, stripe-like concentration stains are easily seen due to scattered reflection. However, when the image printed on the transparent film is seen through the transparent film, scattered reflection does not occur due to high smoothness of the surface since the surface is a film surface, and thus the stripe-like concentration stains are not easily seen. The dot-forming operation of the second printing mode provides a greater number of the passes of the nozzles to form one dot line, which is arranged in the intersecting direction, than the dot-forming operation of the first printing mode does, so that the second printing mode can print an image in which the concentration stains are not easily seen. In addition, the concentration stains are easily seen when the image printed in the first printing mode is seen directly. However, the concentration stains are not easily seen when the printed image is seen as a positive image through the transparent film. Therefore, in the case of printing a mirror image to form an image to be seen through the transparent film, it is possible to reduce the number of the passes of the nozzles to form one dot line, thereby printing the image more rapidly.

In the printing apparatus, the medium may be transported so that the transportation operation of the second printing mode provides smaller intervals in the transport direction of a plurality of dot lines than the transportation operation of the first printing mode does, wherein the dots of the dot lines are arranged in the intersecting direction to form the image.

According to this printing apparatus, it is possible to print an image, in which concentration stains are not easily seen, since the image printed in the second printing mode for printing a positive image has smaller intervals of the dot line in the transport direction.

In the printing apparatus, the dot-forming operation of the second printing mode may form a dot line, in which the dots are arranged in the intersecting direction to form the image, by ejecting ink when moving the nozzle in a predetermined direction. The dot forming operation of the first printing mode may form the dot line by ejecting ink when moving the nozzle in the predetermined direction and a direction opposite to the predetermined direction.

According to the printing apparatus, the image printed in the second printing mode can have high precision in positions where the dots are formed and be printed with higher quality since the nozzles are moved in the same direction when ink is ejected to form the dot line. In the image printed in the first printing mode, the nozzles move in an alternating direction when ejecting ink to form a raster line. Accordingly, since concentration stains are not easily seen when the printed image is seen through the transparent film, it is possible to print the image more rapidly.

In the printing apparatus, the dot-forming operation of the second printing mode and the dot-forming operation of the first printing mode may form one dot line, in which the dots are arranged in the intersecting direction to form the image, by ejecting ink from a plurality of nozzles different each other. The second printing mode may have a greater number of nozzles which eject ink to form one dot line, than the first printing mode does.

According to the printing apparatus, since the dot-forming operation of the second printing mode uses a greater number of nozzles ejecting ink to form the dot line, in which the dots are arranged in the intersecting direction, than the dot-forming operation of the first printing mode does, it is possible to form an image, in which concentration stains are not easily seen, in the second printing mode. In addition, concentration stains are easily seen in the image printed in the first printing mode when the image is seen directly. However, since the mirror image is being printed, the concentration stains are not easily seen when the image is seen through the transparent film. Accordingly, in the case of printing the image to be seen through the transparent film by printing the mirror image, it is possible to print the image more rapidly by reducing the number of the nozzles that form one dot line.

In the printing apparatus, the dot-forming operation of the first printing mode may eject ink from a single nozzle in order to form one dot line.

According to the printing apparatus, since one dot line of the image printed in the first printing mode, in which the concentration stains are not easily seen due to seeing through the medium, is formed using one nozzle, it is possible to print the image more rapidly.

In the printing apparatus, at least one of the first printing mode and the second printing mode may print a background image that serves as a background of the printed image.

According to the printing apparatus, when the printing is performed in at least one of the first and second printing modes, the image is printed on the background image. Even if the image is printed on the transparent film, a transparent portion is not present in the printing area, on which the image and the background image are printed. Accordingly, an object beyond the transparent film cannot be seen through the transparent portion of the area of the image, and thus it is possible to print a clear image.

The printing apparatus according to another exemplary embodiment of the invention is for printing an image on a medium, which is transported in a transport direction, by forming dots by ejecting ink from a plurality of nozzles while moving the nozzles in an intersecting direction that intersects the transport direction. The printing apparatus has a first printing mode for printing the image on the medium as an image to be seen through the medium and a second printing mode for printing the image on the medium as an image to be seen directly, the medium being a transparent medium. The first printing mode is different from the second printing mode in at least one of a transportation operation of transporting the medium and a dot-forming operation of forming the dots by ejecting ink while moving the nozzles.

According to the printing apparatus, since the first printing mode for printing the image, which is supposed to be seen through the transparent medium, on the transparent medium and the second printing mode for printing the image to be seen directly on the medium are different in at least one of the transportation operation and the dot-forming operation. Therefore, it is possible to print the image to be seen through the transparent medium and the image to be seen directly by the proper transportation operation and the proper dot-forming operation. Therefore, the image can be printed rapidly both in the case of printing the mirror image on the transparent medium and in the case of printing the positive image on the medium so that stripe patterns caused by stains or the like are not seen.

The fact that the first printing mode and the second printing mode are different in at least one of the transportation operation and the dot-forming operation means that the transportation operations are different in the amount of transporting the medium or transportation timing or the dot-forming operations are different in the direction of moving the nozzles when ejecting ink or in ink-ejecting timing when the same image is printed in the first printing mode and in the second printing mode. Accordingly, this does not include the case of printing different images in which ink is ejected onto different positions of the medium to form dots.

In addition, the image to be seen directly and the image to be seen through the transparent medium are different in terms of the selection of the user who operated the printing, the settings of the printer, or the like. For example, when the image is an image that cannot be seen through the medium, the selected medium is not transparent, or the background image is printed prior to the image on the transparent medium. When the image is an image to be seen through the medium, the medium is a transparent medium, and the background image is printed on the image, which is printed on the transparent medium.

The printing apparatus according to yet another exemplary embodiment of the invention is for printing an image on a medium, which is transported in a transport direction, by forming dots by ejecting ink from a plurality of nozzles while moving the nozzles in an intersecting direction that intersects the transport direction. The printing apparatus includes a printing apparatus controller that allows a user to select between a first printing mode for printing the image on the medium as an image to be seen through the medium and a second printing mode for printing the image on the medium as an image to be seen directly, the medium being a transparent medium. The printing apparatus controller displays a printing mode-selecting section which selects a printing mode on a user interface screen, the printing mode-selecting section allowing the user to select between the printing modes. First printing type is displayed on the user interface screen when the first printing mode is selected, the first printing type defining a transportation operation of transporting the medium and a dot-forming operation of forming the dots by ejecting ink while moving the nozzles. Second printing type is displayed on the user interface screen when the second printing mode is selected, the second printing type being different from the first printing type in at least one of the transportation operation and the dot-forming operation.

According to the printing apparatus, the user can simply perform printing according to the printing type set as default by only selecting the surface printing mode or the backside printing mode on the user interface screen.

In the printing apparatus, the first printing type may be superior in image-forming speed to the second printing type. The second printing type may be superior in quality of the image to be formed to the first printing type.

According to the printing apparatus, it is possible to optically combine clear image quality and printing speed in the printing according to the direction in which the printed image is seen.

In the printing apparatus, the user may be allowed to change the printing type on the user interface screen after the first or second printing type is displayed on the user interface screen.

According to the printing apparatus, the quality and printing speed of the printing image can be selected in accordance with the preference of the user.

The printing apparatus according to yet another exemplary embodiment of the invention is for printing an image on a medium, which is transported in a transport direction, by forming dots by ejecting ink from a plurality of nozzles while moving the nozzles in an intersecting direction that intersects the transport direction. The printing apparatus includes a printing apparatus controller that allows a user to select between a first printing mode for printing the image on the medium as an image to be seen through the medium and a second printing mode for printing the image on the medium as an image to be seen directly, the medium being a transparent medium. The printing apparatus controller displays a printing mode-selecting section, which selects the printing modes, and a printing type-selecting section, which selects a plurality of printing types, defining a dot-forming operation of forming the dots by ejecting ink while moving the nozzles on a user interface screen. A plurality of the printing types include first and second printing types, the first printing type being different from the second printing type in at least one of the transportation operation and the dot-forming operation. The first printing type when the first printing mode is selected is different from the first printing type when the second printing mode is selected in at least one of the transportation operation and the dot-forming operation.

According to the printing apparatus, the user can select the surface printing mode or the backside printing mode on the user interface screen and select a predetermined printing type. In this manner, the user can simply print the image using the quality and printing speed of the image set to the preference of the user.

In the printing apparatus, the first printing type may be superior in image-forming speed to the second printing type and the second printing type is superior in quality of the image to be formed to the first printing type when the first and second printing types belong to the same printing mode. The first printing mode may be superior in image-forming speed to the second printing mode and the second printing mode is superior in quality of the image to be formed to the first printing mode when the first and second printing modes have the same printing type.

According to the printing apparatus, it is possible to print the image using more appropriate quality and printing speed even in the same printing type by determining whether to perform the backside printing or the surface printing.

In the following exemplary embodiments, an ink jet printer (hereinafter, also referred to as a printer) as a printing apparatus and a printing system having a computer, which is connected to the printer so as to communicate therewith, will be described by way of example.

Figure 2:
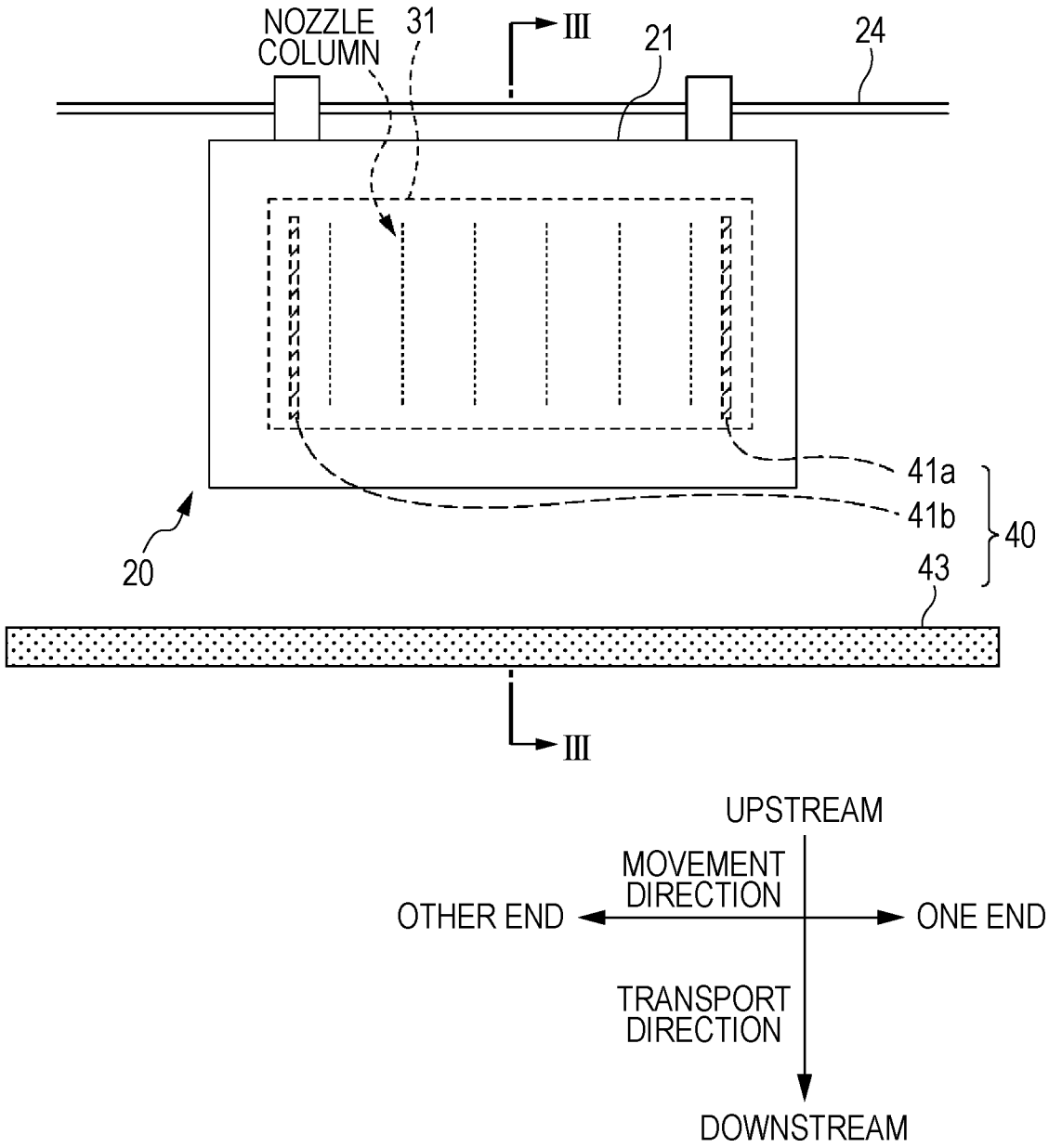
FIG. 2 is a schematic view showing the surroundings of a head of the printer.
Figure 3:
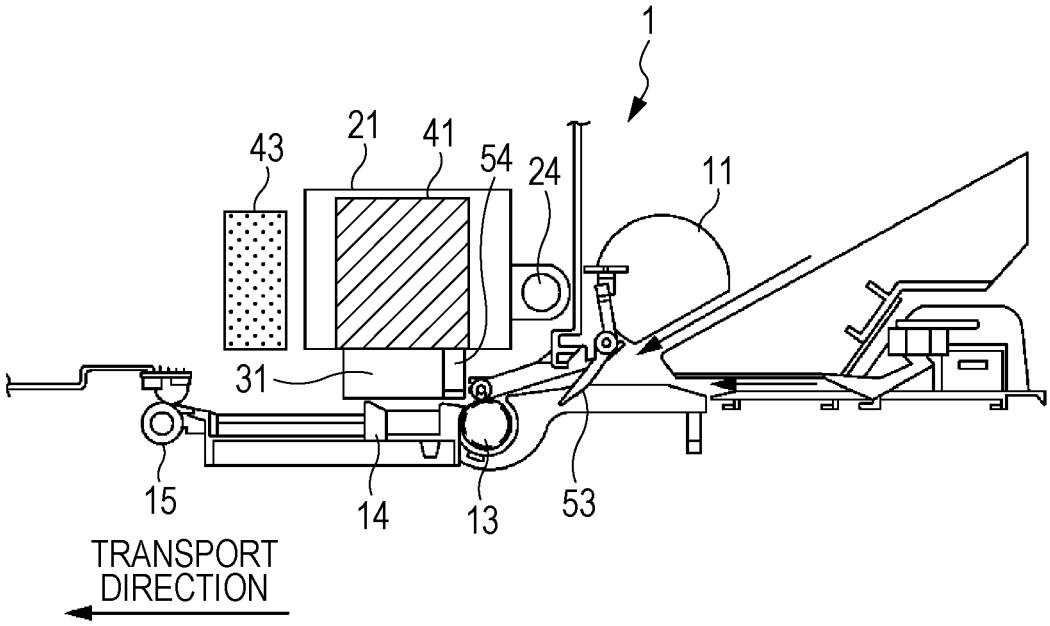
FIG. 3 is a cross-sectional view taken along line III-III of FIG. 2.

Below, a description will be given of a printing system 100 and a printer 1 according to an exemplary embodiment of the invention with reference to FIGS. 1 to 3. FIG. 1 is a block diagram showing the configuration of the printing system and the printer, FIG. 2 is a schematic view showing the surroundings of a head of the printer, and FIG. 3 is a cross-sectional view taken along line III-III of FIG. 2.

As shown in FIG. 1, the printing system 100 includes the printer 1 and a computer 80, which is connected to the printer 1 so as to communicate therewith. The computer 80, which is connected to the printer 1 so as to communicate therewith, has an operation section (not shown), which is to be operated by a user or the like. The computer 80 also has a printer driver installed therein. The printer driver converts image data to be printed based on information, which the user or the like inputs using the operation section, into printing data, which can be printed by the printer 1. The image data, which is to be printed by the printer 1, is also generated by the processing of the printer driver.

Configuration of Printer

The printer 1 of this exemplary embodiment is a color ink jet printer that can print an image on a medium by ejecting ink, for example, an ultraviolet curing ink (hereinafter, referred to as UV ink), which cures due to ultraviolet (hereinafter, referred to as UV) radiation toward a medium such as a sheet of paper, cloth, film, or the like. Here, available examples of the medium include a transparent medium such as a transparent film sheet.

When the printer 1 performs printing on a transparent medium, it can print both an image, which is supposed to be seen directly from a printed side of the transparent medium, and an image, which is supposed to be seen through the transparent medium. The image to be seen directly is generally a positive image of a basis image, which is read by a scanner or taken by a digital camera, and the image to be seen through the transparent film is generally a mirror image of the basis image. However, in the case in which an image, which has bilateral symmetry, or an image, which is bilaterally reversed to the basis image, is supposed to be printed, the present invention is not limited thereto.

In addition, the UV ink is a type of ink that includes a UV curing resin, and cures due to the photopolymerization of the UV curing resin when subjected to UV radiation. In addition, the printer 1 of this exemplary embodiment performs printing using four color UV inks such as CMYK UV inks and a white (W) UV ink for printing a back ground image.

The printer 1 includes a transport unit 10, a carriage unit 20, a head unit 30, a radiation unit 40, a detector group 50, and a controller 60. When printing data is received from the computer 80 as an external device, the printer 1 controls respective units (such as the transport unit 10, the carriage unit 20, the head unit 30, and the radiation unit 40) using the controller 60. The controller 60 prints an image on the medium by controlling the respective units based on the printing data received from the computer 80. The state of inside of the printer 1 is monitored bt the detector group 50. The detector group 50 outputs a detection result to the controller 60. The controller 60 controls the respective units based on the detection result output from the detector group 50.

The transport unit 10 is for transporting the medium in a predetermined direction (hereinafter, referred to as transport direction). The transport unit 10 includes a feed roller 11, a transport motor (not shown), a transport roller 13, a platen 14, and a discharge roller 15. The feed roller 11 is a roller for feeding the medium, fed into a paper feed port, into the printer 1. The transport roller 13 is a roller that transports the medium, fed by the feed roller 11, to an area in which the medium can be printed (i.e., a printable area), and is driven by a transport motor. The platen 14 supports the medium while printing is being performed on the medium. The discharge roller 15 is a roller that discharges the medium from the printer, and is provided downstream of the printable area in the transport direction.

The carriage unit 20 is for moving (also referred to as "scanning") the head in an intersecting direction (also referred to as a "movement direction") that intersects the transport direction. The carriage unit 20 includes a carriage 21 and a carriage motor (not shown). Also, the carriage 21 detachably maintains an ink cartridge that contains a UV ink. In addition, the carriage 21 is reciprocally moved by the carriage motor along a guide shaft 24, which is supported on the guide shaft 24 intersecting the transport direction as will be described later.

The head unit 30 is for ejecting an ink (i.e., a UV ink in this exemplary embodiment) onto the medium. The head unit 30 includes a head 31 that has a plurality of nozzles. Since the head 31 is provided in the carriage 21, it moves along the movement direction when the carriage 21 moves in the movement direction. In addition, a raster line is formed as a dot line in the movement direction on the medium by intermittently ejecting the UV ink while the head 31 is moving in the movement direction. In addition, herein, in the movement of the head 31, the movement from one side to the other side in FIG. 2 is referred to as "proceeding," and the movement from the other side to one side in FIG. 2 is referred to as "returning."

In addition, the configuration of the head 31 will be described later.

The radiation unit 40 is for radiating UV rays toward the UV ink, which is deposited on the medium. The dots formed on the medium are cured by the UV radiation from the radiation unit 40. The radiation unit 40 of this exemplary embodiment includes pre-curing radiation sections 41*a* and 41*b* and a main curing radiation section 43. In addition, details of the pre-curing radiation sections 41*a* and 41*b* and the main curing radiation section 43 will be described later.

The detector group 50 includes a linear encoder (not shown), a rotary encoder (not shown), a paper detection sensor 53, an optical sensor 54, and the like. The linear encoder detects the position of the carriage 21 in the movement direction. The rotary encoder detects the amount of rotation of the transport roller 13. The paper detection sensor 53 detects a position of an end of the medium which is being fed. The optical sensor 54 detects the presence of the medium using a light-emitting section and a light-receiving section, which are mounted on the carriage 21. Also, the optical sensor 54 can detect the width of the medium by detecting the position of the end of the medium while being moved by the carriage 21. In addition, in some cases, the optical sensor 54 can detect the leading edge (which is the end downstream in the transport direction and also referred to as the upper end) or the trailing edge (which is the end upstream in the transport direction and also referred to as the lower end) of the medium or whether or not the medium is transparent.

The controller 60 is a control unit (i.e., a control section) that controls the printer 1. The controller 60 includes an interface section 61, a Central Processing Unit (CPU) 62, memory 63, and a unit control circuit 64. The interface section 61 performs data transmission and reception between the computer 80 as the external device and the printer 1. The CPU 62 is a computing device for performing the overall control of the printer 1. The memory 63 is for ensuring an area in which a program of the CPU 62 is stored, an operation area, or the like, and includes a memory device such as Random Access Memory (RAM), Electrically Erasable Programmable Read Only Memory (EEPROM), or the like. The CPU 62 controls respective units via the unit control circuit 64 according to the program stored in the memory 63.

In the printing, the controller 60 prints an image composed of a plurality of dots on a sheet of paper by alternately repeating a dot-forming operation of ejecting a UV ink from the head 31, which is being moved in the movement direction as will be described later, and a transport operation of transporting the sheet of paper in the transport direction. Here, the term "pass" relates to the operation of forming dots. In addition, nth pass is referred to as "pass n."

Configuration of Head 31

Figure 4:
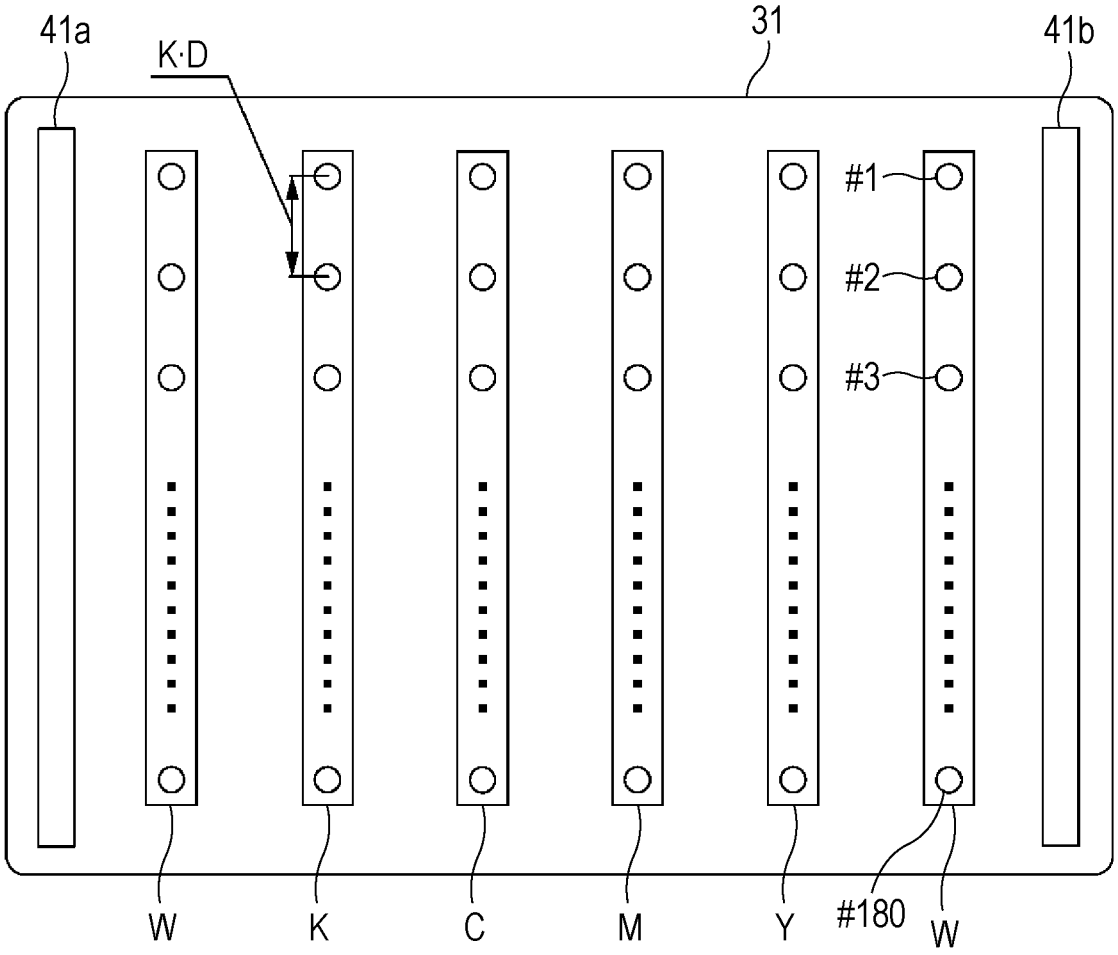
FIG. 4 is an explanatory view showing the configuration of the head.
Figure 4:
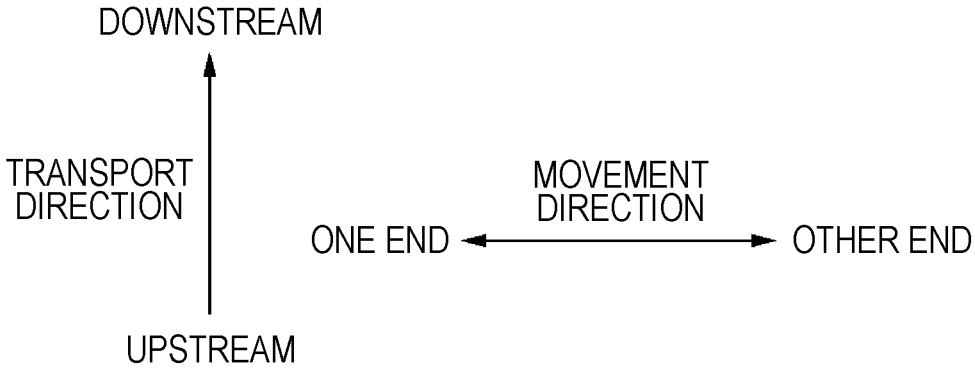

FIG. 4 is an explanatory view showing an example of the configuration of the head 31. As shown in FIG. 4, a black ink nozzle row K, a cyan ink nozzle row C, a magenta ink nozzle row M, a yellow ink nozzle row Y, and two white ink nozzle rows W are provided on the underside of the head 31. These nozzle rows are arranged as shown in FIG. 4. Specifically, the white ink nozzle rows W are arranged on both ends in the movement direction, and the black ink nozzle row K, the cyan ink nozzle row C, the magenta ink nozzle row M, and the yellow ink nozzle row Y are arranged sequentially from one end to the other end between the two white ink nozzle rows W. In addition, each of the respective nozzle rows has a plurality of nozzles (180 nozzles in this exemplary embodiment) as ejection ports for ejecting a UV ink of each color.

The nozzles of the respective nozzle rows are arranged at predetermined intervals (i.e., a nozzle pitch: k·D) in the transport direction. Here, D is a minimum dot pitch (i.e., the interval in the maximum resolution of the dots formed on the medium) in the transport direction. In addition, k is an integer equal to or greater than 1. For example, k is 4 when the nozzle pitch is 180 dpi (1/180 inch) and the dot pitch in the transport direction is 720 dpi (1/720 inch).

The respective nozzles are designated by corresponding numbers. Particularly, if a nozzle is more downstream in the transport direction, a smaller number is given. In each nozzle, a piezoelectric device (not shown) is provided as a drive device for ejecting a UV ink from the nozzle. Droplets of the UV ink are ejected from the nozzle when the piezoelectric device is driven by a drive signal. The ejected UV ink is deposited on the medium, thereby forming dots.

Arrangement of Radiation Section

The pre-curing radiation sections 41*a* and 41*b* are provided outside the nozzle rows C, M, Y, K, and W lined up in the intersection direction, adjacent to the white ink nozzle rows W located on both ends of the nozzle rows C, M, Y, K, and W, so that the six nozzle rows C, M, Y, K, and W are interposed between the pre-curing radiation sections 41*a* and 41*b*. Due to this configuration, it is possible to radiate UV rays even if the ink is ejected while the carriage 21 is moving from one end to the other end or vice versa.

In addition, the main curing radiation section 43 is formed to be longer than the width of the medium, on which printing is supposed to be performed, and is arranged downstream of the head 31 in the transport direction.

Pre-Curing and Main Curing

In this exemplary embodiment, the dots are cured by performing UV radiation on the UV ink, which is deposited onto the medium. The printer 1 of this exemplary embodiment performs two-stage curing since it has the pre-curing radiation sections 41*a* and 41*b* as a radiation unit 40, which perform UV radiation for pre-curing of the UV ink, and the main curing radiation section 43, which performs UV radiation for the main curing. In addition, the pre-curing is to cure the surface of dots in order to suppress the fluctuation of the UV ink (i.e., the spread of the dots), which is deposited on the medium, or to prevent the ink from permeating between the dots. The main curing is to cure the UV ink completely. Therefore, the main curing has greater radiation energy (i.e., a greater amount of radiation). Each of the pre-curing radiation section 41*a* and 41*b* and the main curing radiation section 43 has a light source that radiates UV rays to a medium.

The pre-curing radiation sections 41*a* and 41*b* are mounted on the carriage 21 as shown in FIGS. 2 and 4. The pre-curing radiation sections 41*a* and 41*b* are moved along with the head 31 in the movement direction, following the movement of the carriage 21. In other words, when the nozzle row of each color of the head 31 is reciprocally moved, the pre-curing radiation sections 41*a* and 41*b* are reciprocally moved while maintaining the relative position with respect to the nozzle row of each color. At this time, UV is radiated toward the medium from the pre-curing radiation sections 41*a* and 41*b*. Specifically, UV is radiated from the pre-curing radiation section 41*a* in the proceeding stage, and UV is radiated from the pre-curing radiation section 41*b* in the returning stage. As such, the pre-curing is performed in the same pass in which the dots are formed. In addition, the light sources of the pre-curing radiation sections 41*a* and 41*b* are housed inside the pre-curing radiation sections 41*a* and 41*b*, respectively, so as to be isolated from the head 31. This, as a result, prevents the UV rays radiated from the light source from leaking through the underside of the head 31, thereby preventing the UV ink from curing around the opening of the respective nozzle formed under the head 31 (i.e., from clogging the nozzle).

The main curing radiation section 43 is provided downstream of the head 31 in the transport direction, with the length in the movement direction being longer than the width of the medium, on which printing is supposed to be performed. In addition, the main curing radiation section 43 radiates UV rays toward the medium without movement. Due to this configuration, when the medium on which the dots are formed by the pass is transported to a position below the main curing radiation section 43, it is subjected to UV radiation by the main curing radiation section 43.

In addition, in this exemplary embodiment, Light Emitting Diodes (LEDs) are used as light sources of the pre-curing radiation sections 41*a* and 41*b*. In the case of the LEDs, it is possible easily to change the amount of radiation energy by controlling the magnitude of an input current. In addition, lamps (e.g., metal halide lamps, mercury lamps, or the like) are also used as a light source of the main curing radiation section 43.

Printing Mode Printable by Printer 1

The printer 1 of this exemplary embodiment has printing mode that can be changed appropriately depending on the operation of a user or the like or based on preset printing conditions. There are multiple types of printing modes, which include a printing mode which is used when it is intended to print more rapidly, a printing mode which is used when it is intended to print a higher-quality image, and the like. In the respective printing modes, at least one of a transport operation of transporting a medium and a dot-forming operation of forming dots by ejecting ink while moving nozzles are different.

Below, a description will be given of examples of the printing mode that can be performed by the printer 1.

Figure 5:
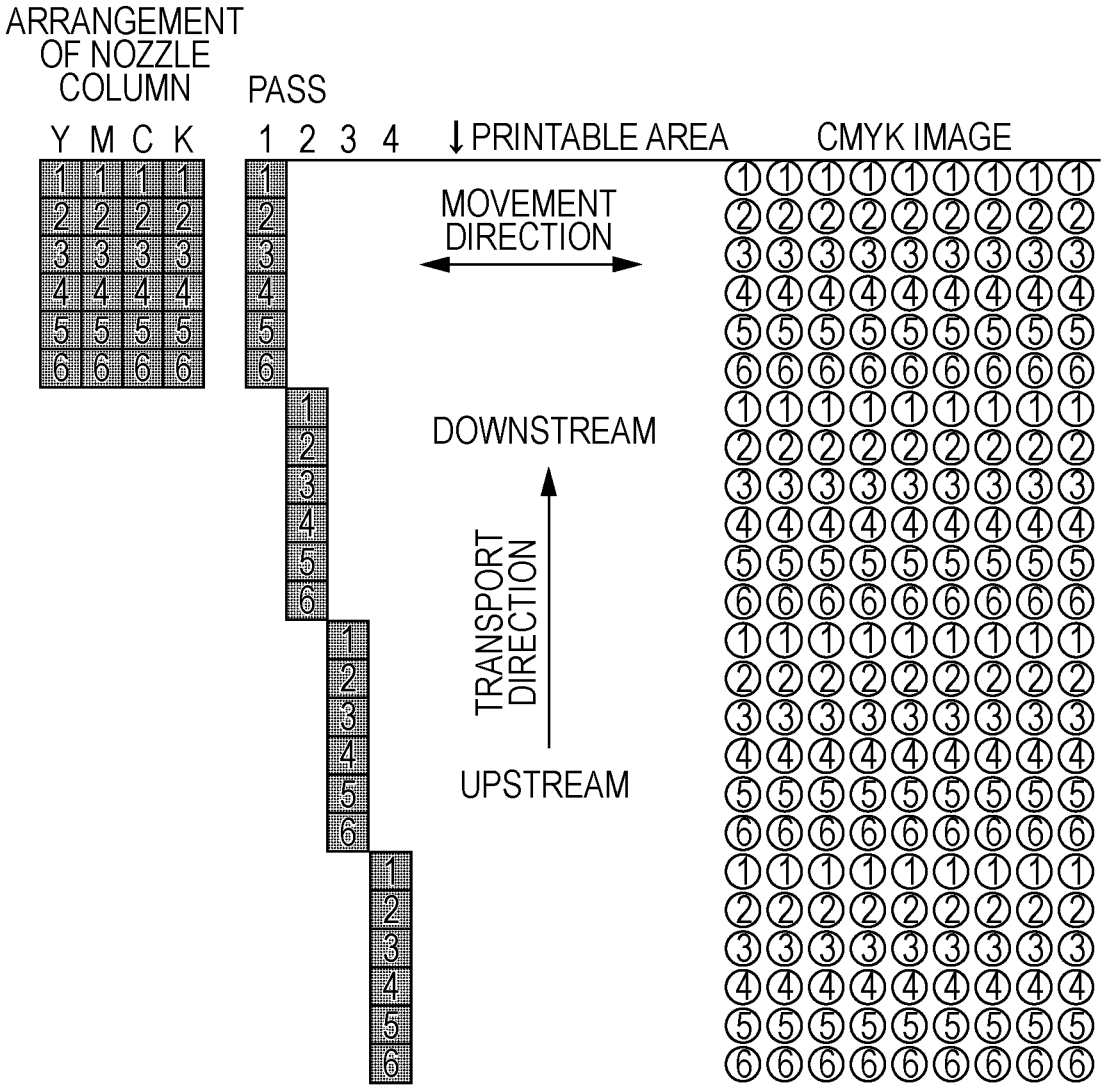
FIG. 5 is a view for explaining a transportation operation and a dot-forming operation in band printing mode.
Figure 6:
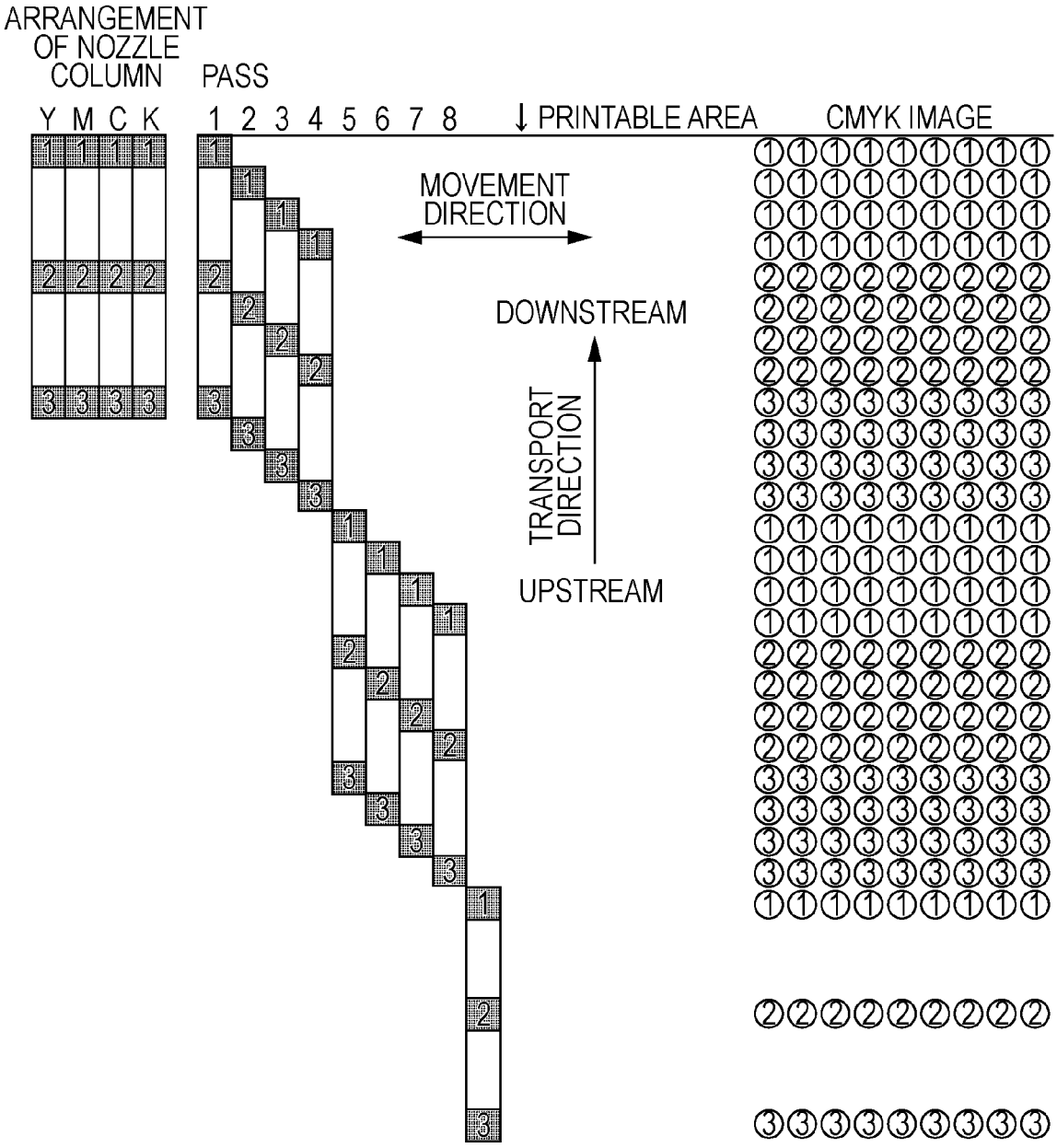
FIG. 6 is a view for explaining a transportation operation and a dot-forming operation in pseudo band printing mode.
Figure 7:
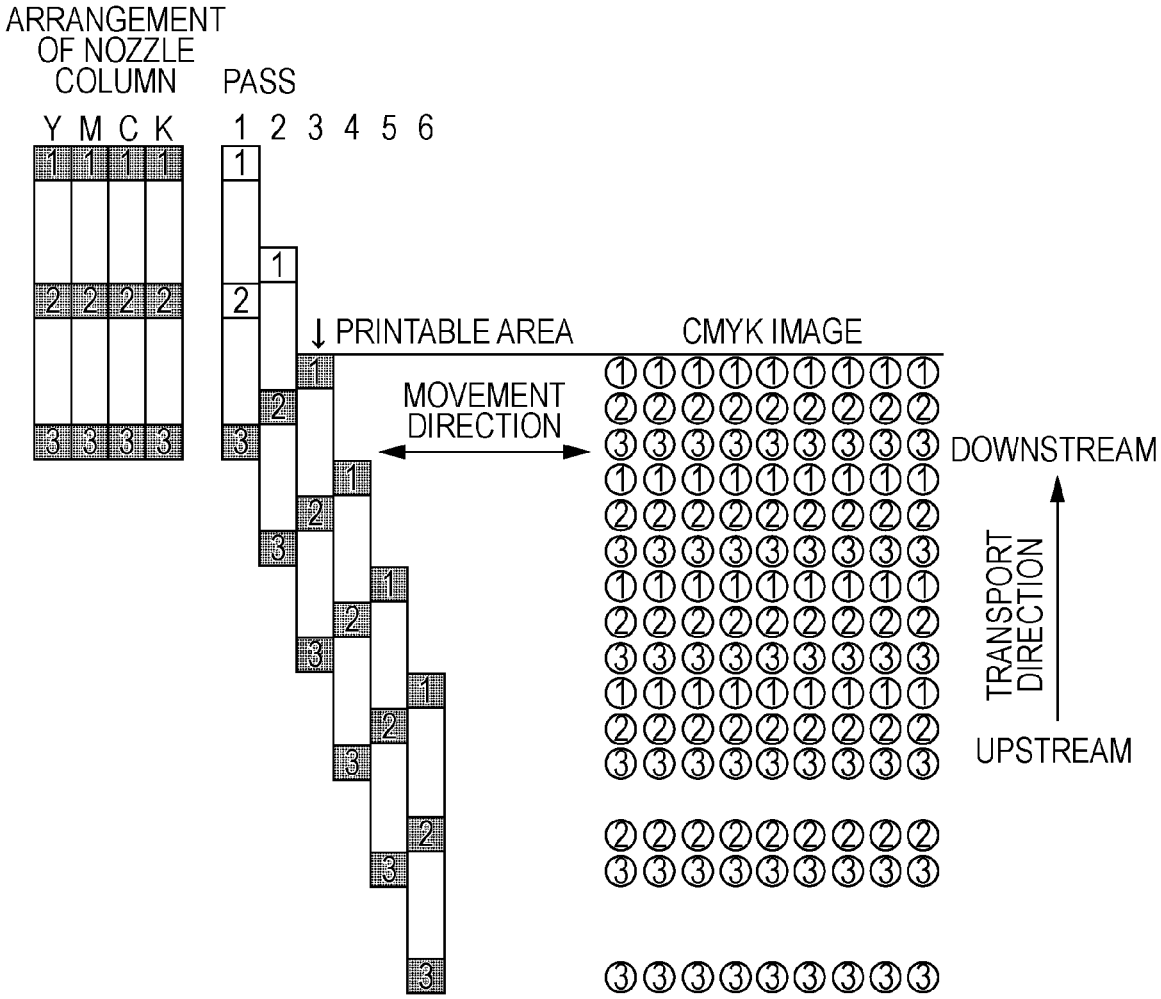
FIG. 7 is a view for explaining a transportation operation and a dot-forming operation in interlace printing mode.
Figure 8:
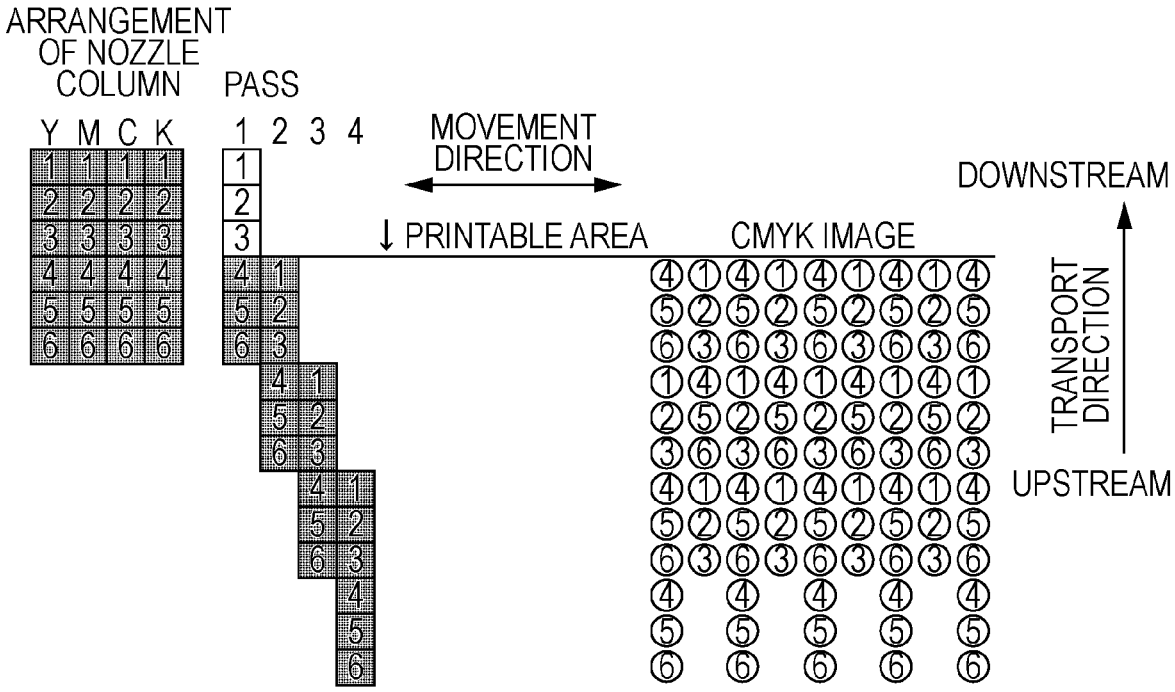
FIG. 8 is a view for explaining a transportation operation and a dot-forming operation in overlapping band printing mode.
Figure 9:
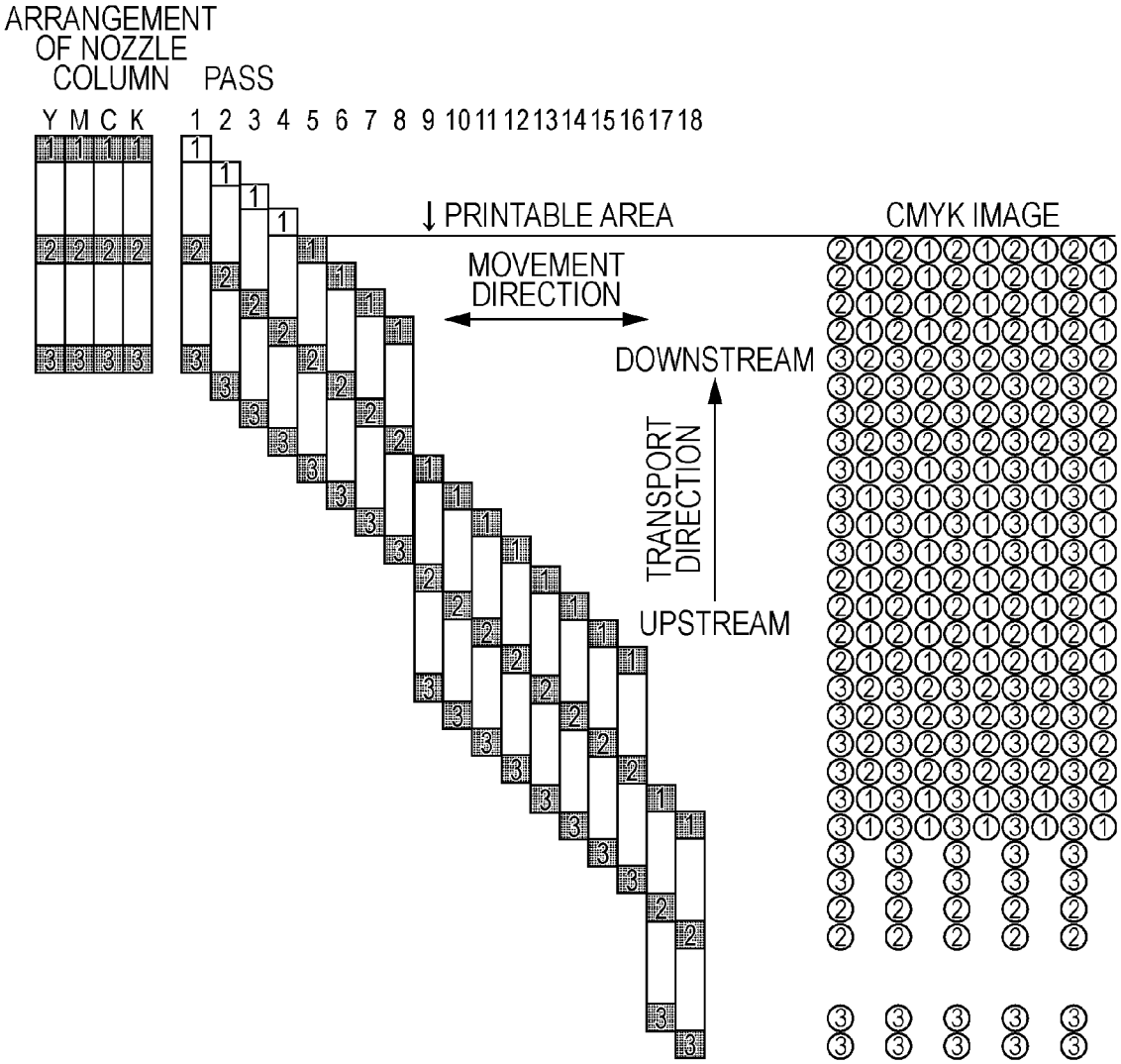
FIG. 9 is a view for explaining a transportation operation and a dot-forming operation in overlapping pseudo band printing mode.
Figure 10:
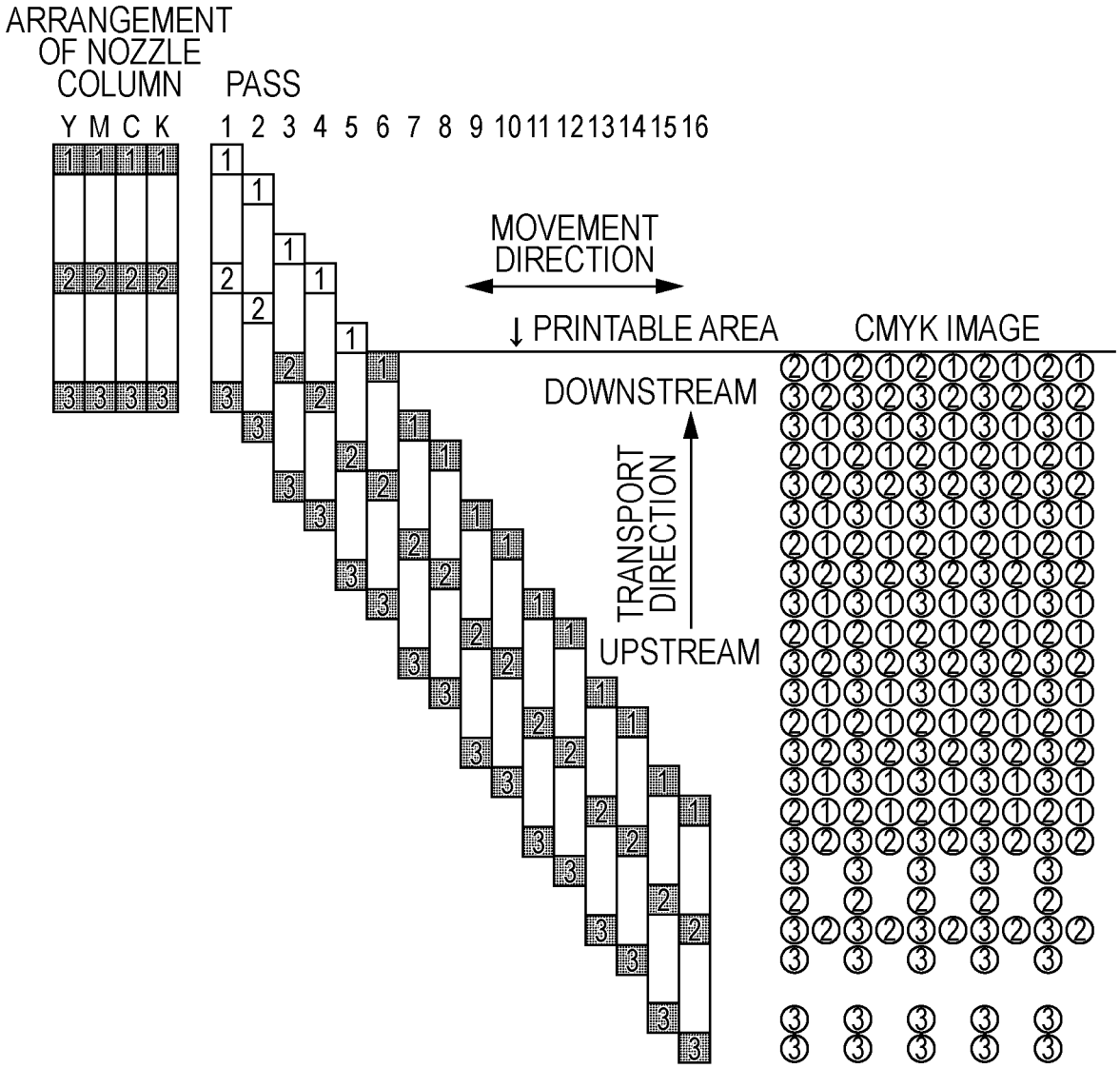
FIG. 10 is a view for explaining a transportation operation and a dot-forming operation in overlapping interlace printing mode.

FIG. 5 is a view for explaining a transportation operation and a dot-forming operation in band printing mode. FIG. 6 is a view for explaining a transportation operation and a dot-forming operation in pseudo band printing mode. FIG. 7 is a view for explaining a transportation operation and a dot-forming operation in interlace printing mode. FIG. 8 is a view for explaining a transportation operation and a dot-forming operation in overlapping band printing mode. FIG. 9 is a view for explaining a transportation operation and a dot-forming operation in overlapping pseudo band printing mode. FIG. 10 is a view for explaining a transportation operation and a dot-forming operation in overlapping interlace printing mode.

In the following description, each head 31 is assumed to have a smaller number of nozzles for the sake of brevity. In the figure, the relative positions of the nozzles and the medium are illustrated. In the real printer 1, the nozzles are not moved in the transport direction. Here, a description will be given of an example in which dots of respective colors are formed on all of a printing area in order to facilitate the understanding of how an image is formed. When the image is printed, ink may not be ejected based on printing data.

Below, in the figures that illustrate the printing modes, the nozzles are represented by rectangles for the sake of convenience, and the numbers inside the rectangles specify the respective nozzle. The left parts of the figures indicate relative positions of the nozzles to the medium in the transport direction at every pass of the movement of the carriage 21 in the image-forming operation. The right parts of the figures provide an indication of an image that is formed when the printing operation is executed in the relative positions as shown in the left parts. As for the nozzles, which eject four color inks, a description will be given of only one color nozzle row of CMYK nozzles since the nozzles of the respective colors can form dots in the same positions if their numbers are the same.

In the left parts of the figures showing the arrangements of the nozzles, nozzles ejecting CMYK inks are marked dark and nozzles ejecting the white ink are marked bright. In each pass, the nozzles, which ejected ink, of each pass are marked the same.

In the right parts of the figures, dots formed by the ejected inks are designated with circles, the numbers inside which indicate nozzles that have ejected the inks to form the dots.

In addition, the inks ejected onto the medium are pre-cured by UV radiation from the pre-curing radiation sections 41*a* and 41*b*, which are transported to the positions opposite to the ejected inks following the movement of the carriage 21, and are then mainly cured by UV radiation, in which the main curing starts from a portion of the inks, which are deposited on the portion of the medium that arrived in the position opposite to the main curing radiation section 43. However, in the following, a description of UV radiation will be omitted.

1. Band Printing Mode

The band printing mode is a printing mode in which printing speed has priority over image quality. In the band printing mode, the pitches of the nozzles lined up in the transport direction are equal to dot pitches of a printed image.

In the band printing mode, for example, as shown in FIG. 5, an image is printed by repeating an operation of forming a raster line by ejecting ink from all of the nozzles #1 to #6 of the respective nozzle rows C, M, Y, and K while the carriage 21 is being proceeded one time, particularly, moved from one end to the other end in the movement direction; an operation of transporting a medium at a distance corresponding to the length of the nozzle row in the transport direction; and then an operation of forming a raster line by ejecting the ink from all of the nozzles of the respective nozzle rows C, M, Y, and K while the carriage 21 is being moved from the other end to one end.

The band printing mode has a fast printing speed since printing is performed over the length of the nozzle rows in the transport direction by the one-time movement of the carriage 21. In addition, each of raster lines, which are formed by the dots lined up in the movement direction, is formed by a single nozzle. In addition, since the raster lines, each of which is formed by a single nozzle, are periodically formed, stripe patterns caused by color stains or the like can be easily seen.

2. Pseudo Band Printing Mode

The pseudo band printing mode is a type of printing mode in which the dot pitch of a printed image is smaller when compared to the pitch of nozzles lined up in the transport direction. In the pseudo band printing mode, a plurality of raster lines, each of which is formed by a single nozzle, are lined up in the transport direction.

In the pseudo band printing mode, as shown in FIG. 6, an image is printed by ejecting ink from all of the nozzles of the respective nozzle rows while moving the carriage 21 is being proceeded one time, particularly, moved from one end to the other end in the movement direction; transporting a medium in the transport direction, at a distance corresponding to 1/n, where n is an integer of the nozzle pitch; and ejecting the ink from all of the nozzles of the respective nozzle rows while moving (i.e., returning) the carriage 21 from the other end to one end. In the example shown in FIG. 6, the medium is transported at a distance corresponding to ¼ of the nozzle pitch between the proceeding and the returning of the carriage.

Afterwards, a raster line is printed by repeating the transportation at a minute distance corresponding to 1/n, where n is an integer of the nozzle pitch, until intervals in a raster line, which is formed in the first proceeding, are filled up by the following raster line. After the intervals in the raster line, which is formed in the first proceeding, are filled up by the following raster line or lines, the image is formed by transporting the medium to the next printing area at once, and then repeating the transportation at a minute distance and the dot-forming operation.

In the pseudo band printing mode, the image is formed smooth since the dot intervals in the transport direction are smaller than those of the band printing mode. However, each of the raster lines, formed by the dots lined up in the movement direction, is formed by a single nozzle in the same manner as in the band printing mode. In addition, since the raster lines, each of which is formed by a single nozzle, are formed periodically also in the transport direction, stripe patterns caused by color stains or the like can be easily seen.

3. Interlace Printing Mode

The interlace printing mode means a type of printing mode in which an unrecorded raster line is interposed between raster lines, which are printed by one pass, with a value k being 2 or greater, where k indicates the ratio of a nozzle pitch with respect to a dot pitch. In the interlace printing, whenever a sheet of paper is transported in the transport direction at a predetermined transport distance F, each nozzle records a raster line directly upstream of a raster line, which is recorded in the preceding pass. In order to perform recording by ensuring the transport distance to be constant, the following conditions are required: (1) The number of nozzles N (integer)

capable of ejecting ink is coprime to k, and (2) the transport distance F is set to be ND, where D is a dot pitch.

By way of an example of the interlace printing mode, as shown in FIG. 7, a raster line is primarily formed by ejecting ink from some nozzles of each nozzle row upstream in the transport direction during the proceeding in which the carriage 21 is moved from one end to the other end as a first movement. Afterwards, the medium is transported at a predetermined distance in the transport direction, and in the returning, a raster line is formed using some nozzles different from those used in forming the first-formed raster line, so as to be adjacent to the first-formed raster line. Next, the medium is transported at a predetermined distance in the transport direction, and during the second proceeding, a raster line is formed using some nozzles different from those used in forming the raster line in the returning, so as to be adjacent to the raster line formed in the returning. Due to the repetition of the operation of transporting the medium at a predetermined distance and the dot-forming operation of forming the raster lines adjacent to each other in the transport direction using different nozzles, the intervals in the previously-formed raster line are filled up by the raster line formed by the different nozzles, thereby forming an image.

In the example shown in FIG. 7, a raster line is formed by ejecting ink from only the third nozzle #3, which is provided most upstream, in the first proceeding, the medium is transported at a distance corresponding to three raster lines, and a raster line is formed by ejecting ink from the second nozzle #2 in positions adjacent to downstream in the transport direction of the raster line, which is formed in the proceeding, while returning the carriage 21. At this time, a raster line is formed by ejecting ink also from the third nozzle #3.

Next, the medium is transported again at a distance corresponding to three raster lines, and then raster lines are formed by ejecting ink from the first and second nozzles #1 and #2, in positions adjacent to downstream in the transport direction of the raster line, which is formed in the returning. At this time, a raster line is formed by ejecting ink also from the third nozzle #3.

In the interlace printing mode, the raster lines adjacent to each other in the transport direction are formed by different nozzles, a variation in the nozzle pitch or a variation in the ink-ejecting characteristics of the nozzles is less apparent when compared to the band printing mode and the pseudo band printing mode. However, since each of the raster lines, formed by the dots lined up in the movement direction, is formed by a single nozzle as in the band printing mode and the pseudo band printing mode, stripe patterns caused by color stains or the like can be easily seen.

4. Overlapping Band Printing Mode

The overlapping band printing mode is a so-called overlapping printing mode in which a raster line, which is formed by a single nozzle in the band printing mode, is formed by a plurality of nozzles (two nozzles in this disclosure) as shown in FIG. 8.

The overlapping band printing mode uses nozzles of one nozzle row by halving the nozzles in the transport direction.

For example, as shown in FIG. 8, a raster line is first formed in a printing area of a transported medium by moving the carriage 21 while ejecting ink from almost half of the nozzles of the nozzle row, which are located upstream in the transport direction. In the example shown in FIG. 8, since the nozzle row has six nozzles, dots are formed by ejecting ink from three nozzles #4, #5, and #6, which are located upstream. At this time, in the movement direction, the dots are formed at intervals, which are greater than the dot intervals of the raster line formed in the band printing mode, for example, at one-dot intervals.

Next, the medium is transported at a distance corresponding to the half of the length of the nozzle row in the transport direction, and a raster line is formed by ejecting ink from all of the nozzles. At this time, each nozzle forms half of the number of the dots of the raster line by forming every other dot. Due to the dot-forming operation of this pass, the upstream half of the nozzles forms a raster line, which will form a new raster line, having intervals in the movement directions, and the downstream half of the nozzles forms dots in the intervals of the raster line, which is formed in the foregoing pass, thereby completing the raster line.

Afterwards, an operation of transporting the medium at a distance corresponding to the half of the length of the nozzle row and an operation of forming a raster line having spaces, each of which corresponds to one dot, in the transport direction by ejecting ink from all of the nozzles are repeated, thereby printing an image.

In the overlapping band printing mode, since a raster line is formed from ink ejected from two nozzles, stripe patterns due to color stains are less apparent and thus image quality is superior when compared to the band printing mode without overlapping. However, printing speed is inferior since only half of the nozzle row is used.

5. Overlapping Pseudo Band Printing Mode

The overlapping pseudo band printing mode is a so-called overlapping printing mode in which a raster line, which is formed using a single nozzle in the pseudo band printing mode without overlapping, is formed using a plurality of nozzles (two nozzles in this disclosure) as shown in FIG. 9.

In the overlapping pseudo band printing mode, the dot pitch of a printed image is smaller than the pitch of nozzles lined up in the transport direction. A plurality of raster lines, formed from ink ejected from a plurality of nozzles, is lined up in the transport direction.

In the overlapping pseudo band printing mode, for example, as shown in FIG. 9, ink is ejected from some upstream nozzles #2 and #3 of a plurality of nozzles (three nozzles in this disclosure) of each nozzle row while the carriage 21 is being proceeded one time, particularly, moved from one end to the other end in the movement direction. At this time, in the movement direction, the dots are formed at intervals, which are greater than the dot intervals of the raster line formed in the pseudo band printing mode without overlapping, for example, in every other pixel.

Afterwards, the medium is transported at a distance corresponding to the dot pitch in the transport direction, and then, ink is ejected using the same nozzles, which were used in forming the dots in the proceeding, onto positions adjacent to the upstream in the transport direction of the previously-formed dots while the carriage 21 is being moved (returned) from the other end to one end. In this manner, an image is printed. Next, a raster line composed of dots, which are spaced apart from each other at a one-pixel interval in the movement direction, is printed by repeating minute transportation at a distance corresponding to the dot pitch until the intervals of the raster line, which is formed in the first proceeding, are filled up by the following raster line.

In addition, when the medium is transported at a distance corresponding to the dot pitch, the nozzles are arranged in positions opposite to the raster line, which is formed by the nozzles located in the upstream. Following the subsequent movement of the carriage, dots are formed between the dots, which are formed by the nozzles in the upstream, thereby completing the raster line. In the example shown in FIG. 9, the raster line is completed by forming dots using the first and second nozzles #1 and #2 located adjacent in the movement direction to the dots, which are formed by the second and third nozzles #2 and #3 in the initial proceeding.

Afterwards, when the dot-forming operation is continued while repeating the transportation at a minute distance corresponding to the dot pitch, a raster line, in which dots formed by the first nozzle #1 alternate with dots formed by second nozzles #2, and a raster line, in which dots formed by the second nozzle #2 alternate with dots formed by third nozzles #3, are completed, and an uncompleted raster line, which is formed by just the upstream third nozzle is formed. Therefore, the dot-forming operation is executed by transporting the medium at a distance, which matches the nozzle pitch to the dot pitch, in order to complete the uncompleted raster line using the first nozzle #1.

6. Overlapping Interlace Printing Mode

The overlapping interlace printing mode is a so-called overlapping printing mode in which a raster line, which is formed using a single nozzle in the interlace printing mode, is formed using a plurality of nozzles (two nozzles in this disclosure) as shown in FIG. 10.

For example, as shown in FIG. 10, first, an uncompleted raster line having wide dot intervals in the movement direction is formed by ejecting ink from just the third nozzle opposite to a printing area of a medium during first proceeding of the carriage 21, in which the carriage 21 is moved from one end to the other end. Afterwards, the medium is returned at a distance corresponding to the dot pitch in the transport direction, and during returning, ink is ejected using only the third nozzle by positioning adjacent to the first-formed dots, thereby forming an uncompleted raster line having wide dot intervals.

Afterwards, the medium is transported in the transport direction by twice the dot pitch, and ink is ejected from the second and third nozzles opposite the printing area of the medium in the proceeding, thereby forming an uncompleted raster line with wide dot intervals. When the medium is transported in the transport direction by the dot pitch, the second nozzle is located in the position opposite to the uncompleted raster line with the wide dot intervals, which is first formed by the third nozzle. Thus, when ink is ejected from the second and third nozzles opposite to the printing area of the medium in the second returning, the ink ejected from the second nozzle forms dots adjacent to the dots, which are first formed by the third nozzle, thereby completing the raster line. Since the dots formed adjacent in the transport direction and the dots formed adjacent in the movement direction are formed by relatively different nozzles while the medium transportation operation and the dot-forming operation are being repeated, the stripe-like concentration stains due to the different ink-ejecting characteristics of the nozzles are not easily seen. In addition, since the transport distance of one pass decreases and the number of raster lines completed by one pass of the carriage decreases, printing speed slows down.

Printing on Transparent Medium

When the printer 1 prints an image on a transparent film as a transparent medium, it can print the image so that the printed image can be seen through the transparent film. Since the medium is transparent, the printed image can be seen from a printed surface of the transparent film as well as from the opposite surface of the transparent film through the transparent film. Accordingly, when the medium is a transparent film, the printer 1 is designed to print an image that can be seen through the transparent film.

Figure 11:
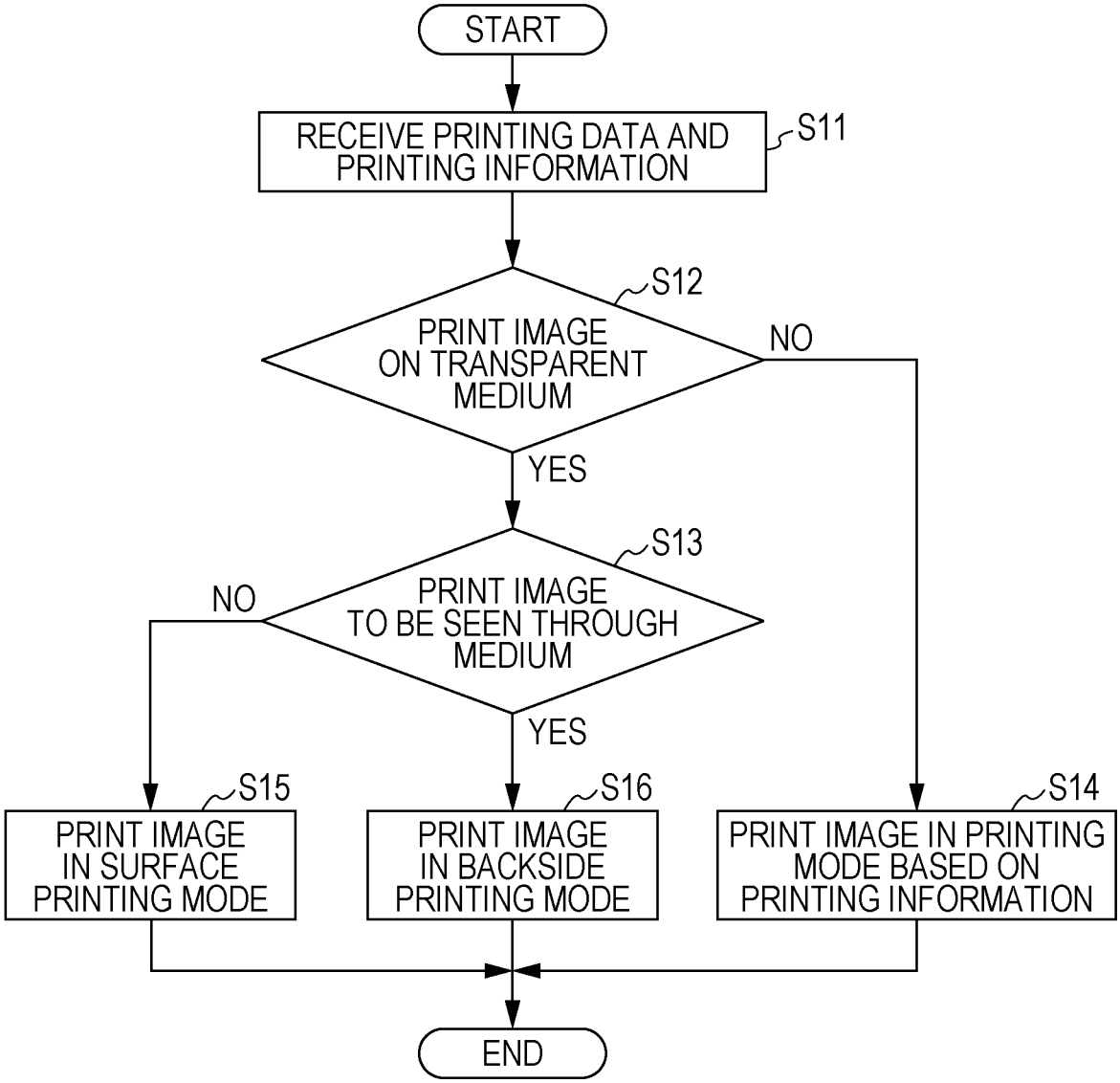
FIG. 11 is a view for explaining an example of processing in which a printer prints an image on a transparent medium.

FIG. 11 is a view for explaining an example of processing in which the printer prints an image on a transparent medium.

Specifically, as shown in FIG. 11, a transparent film is selected as a printing medium by a user of the printer 1 or the like (S11, S12). Next, based on whether a printing image is supposed to be seen directly from a printed side or to be seen through the transparent film (S13), the printing mode is changed (S15, S16).

In general, the printer is required to print a higher-quality image more rapidly. In the case in which an image is printed on a medium such as a sheet of paper and the printed image is seen from a printed surface, stripe-like concentration stains are easily seen due to irregular reflection. Thus, in the case of printing a high-quality image, the interlace printing mode or overlapping printing mode is selected appropriately according to the level demanded for the image quality by, for example, lowering the printing speed. In addition, in the case of printing text or the like, printing time is reduced by printing, for example, in the band printing mode by allowing the stripe-like concentration stains or the like to occur.

However, in the case in which the image printed on transparent film is seen through the transparent film, there are characteristics such that the surface acts as a film surface, the high smoothness of the surface prevents scattered reflection, and concentration stains such as stripe patterns are not easily seen.

Thus, backside printing mode and surface printing mode are set to the printer 1. The backside printing mode is the first printing mode for printing an image to be seen through the transparent film, and the surface printing mode is the second printing mode for printing an image to be seen directly.

For example, the interlace printing mode is set as surface printing mode for printing an image to be seen directly (i.e., a direct view image), and the band printing mode or pseudo band printing mode is set as backside printing mode for printing an image to be seen through the transparent film (i.e., a seen-through-film image).

In addition, both the surface printing mode and the backside printing mode can be set as one selected from among the band printing mode, the pseudo band printing mode, and the interlace printing mode. Particularly, the surface printing mode can be set as an overlapping printing mode, and the backside printing mode can be set as any type of printing mode without overlapping.

In addition, both the surface printing mode and the backside printing mode can be an overlapping printing mode, and the number of the passes of the carriage 21 to form dots of one raster line or the number of nozzles to form dots of one raster line in the surface printing mode can be set to be greater than that of the backside printing mode.

First Exemplary Embodiment

Specifically, when an image is supposed to be printed on a transparent film, a printing operation is executed by the user as he/she designates the transparent film as a medium and selects an image, which is supposed to be seen directly, or an image, which is supposed to be seen through the transparent film, using the computer 80, which is connected to the printer 1 so as to communicate therewith.

When data of an image to be printed is designated and information related to printing the image to be printed as an image to be seen directly is input, the printer driver generates printing data for printing a positive image of the image to be printed, and printing information related to printing in surface printing mode is added to the printing data, which is then sent to the printer 1.

Figure 12:
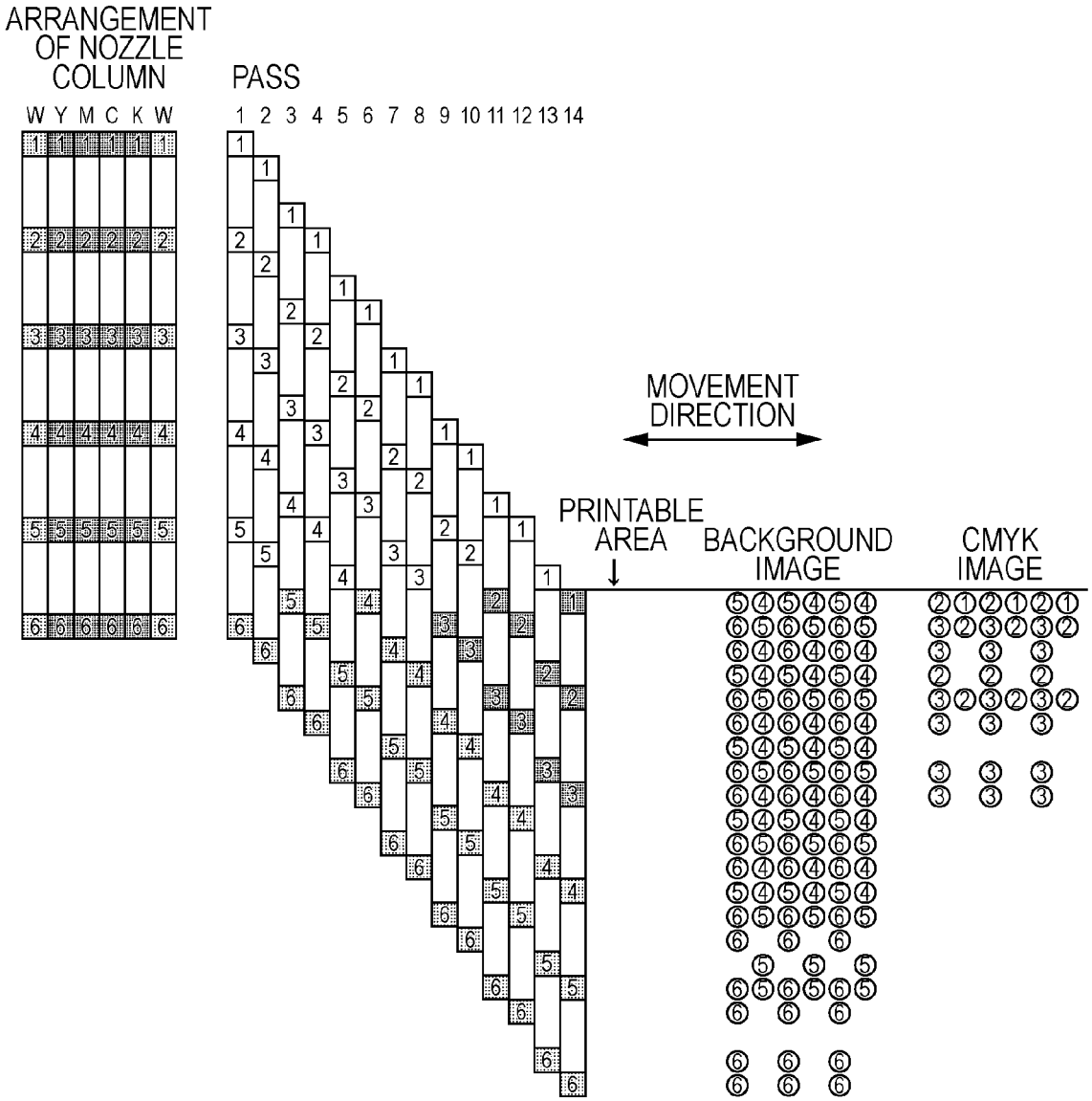
FIG. 12 is a view for explaining a transportation operation and a dot-forming operation as well as a configuration in which dots are formed in overlapping interlace printing mode, which is executed as surface printing mode.

FIG. 12 is a view for explaining a transportation operation and a dot-forming operation as well as a configuration in which dots are formed in overlapping interlace printing mode, which is executed as the surface printing mode. Although FIG. 12 shows a CMYK image and a background image as being distinct from each other, the CMYK image is printed on the background image in practice.

The printer 1 receives printing data and printing information (S11), and the controller 60 determines, based on the received printing information, whether or not to print on a transparent medium and whether or not to print an image to be seen through the transparent medium (S12, S13). In this case, when it is determined to print an image to be seen directly on the transparent film, a printing program of the surface printing mode, which is to print the image to be seen directly, is executed (S15). In this case, for example, the overlapping interlace printing mode is set as the surface printing mode, the image is printed by the execution of a transportation operation of the transparent film and a dot-forming operation as shown in FIG. 12. The overlapping interlace printing mode shown in FIG. 12 is different from the overlapping interlace printing mode, which is described above with reference to FIG. 10, in that the background image is printed using white ink. Since the transparent film is a transparent medium, the portion of the film, on which CMYK ink is not ejected, stays transparent. Then, a printed image rarely provides a clear image since an object beyond the transparent film can be seen through the transparent portion of the film. Therefore, the surface printing mode of this exemplary embodiment is set to print the white background image on the surface of the transparent film before printing respective components of the CMYK image so that the image looks the same as printed on a sheet of white paper.

In the example shown in FIG. 12, the background image is printed using upstream nozzles of a white ink nozzle row W, located adjacent to the leading end of the carriage 21 in the movement direction, up to eight passes (i.e., four times of proceeding and four times of returning) and, from the ninth pass, in the downstream nozzles, the respective components of the CMYK image are printed on the previously-printed background image while the background image is being printed using upstream nozzles of the white ink nozzle row W.

In addition, when data of an image to be printed and information related to printing the image to be printed as an image to be seen through the transparent film are input from the computer 80 by the user, the printer driver generates printing data for printing a mirror image of the image to be printed and printing information related to printing in surface printing mode is given to the printing data, which is then sent to the printer 1.

When the printer 1 receives the printing data and the printing information, the controller 60 executes a printing program for printing the mirror image based on the printing information (S16). At this time, for example, if the interlace printing mode without overlapping is set as the backside printing mode, the image is printed by the execution of a transportation operation of the transparent film and a dot-forming operation as shown in FIG. 13.

Figure 13:
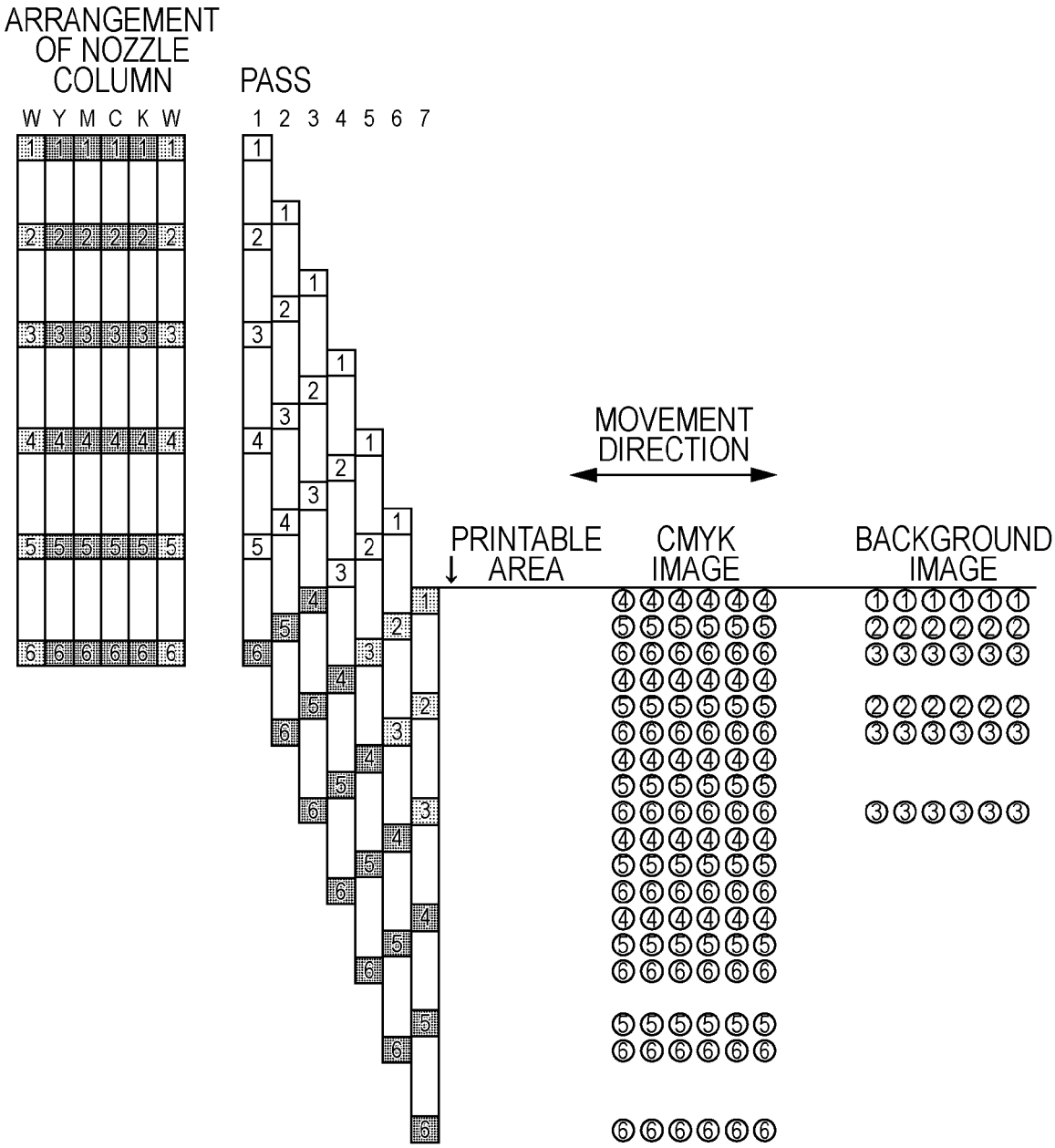
FIG. 13 is a view for explaining a transportation operation and a dot-forming operation as well as a configuration in which dots are formed in interlace printing mode without overlapping, which is executed as backside printing mode.

FIG. 13 is a view for explaining a transportation operation and a dot-forming operation as well as a configuration in which dots are formed in the interlace printing mode without overlapping, which is executed as the backside printing mode. Although FIG. 13 shows a CMYK image and a background image as being distinct from each other, the CMYK image is printed on the background image in practice.

The interlace printing mode without overlapping shown in FIG. 13 is different from the interlace printing mode without overlapping, which is described above with reference to FIG. 7, in that the background image is printed using white ink.

In the case of the image to be seen through the transparent film, the portion of the transparent film, on which CMYK ink is not ejected, stays transparent. Then, the image printed on the transparent film rarely provides a clear image since an object beyond the transparent film can be seen through the transparent portion of the film. Therefore, the backside printing mode of this exemplary embodiment is set to print the white background image on all of the printing area to cover respective components of the CMYK image, which is formed on the transparent film, so that the image looks the same as printed on a sheet of white paper.

In the example shown in FIG. 13, first, the respective components of the CMYK image are printed using upstream nozzles of ink nozzle rows of CMYK colors, located upstream in the transport direction, up to four passes (i.e., two times of proceeding and two times of returning) and, from the fifth pass, the background image is printed on all of the printing area by ejecting white ink using downstream nozzles of the white ink row, located adjacent to the rear end of the carriage 21 in the movement direction, while the respective components of the CMYK image are being printed using the upstream nozzles.

Here, when the user or the like inputs information related to printing, for example, a laterally-symmetric design image as the image to be seen through the transparent medium, a positive image rather than the mirror image can be printed based on the information input from the user or the like.

Figure 16:
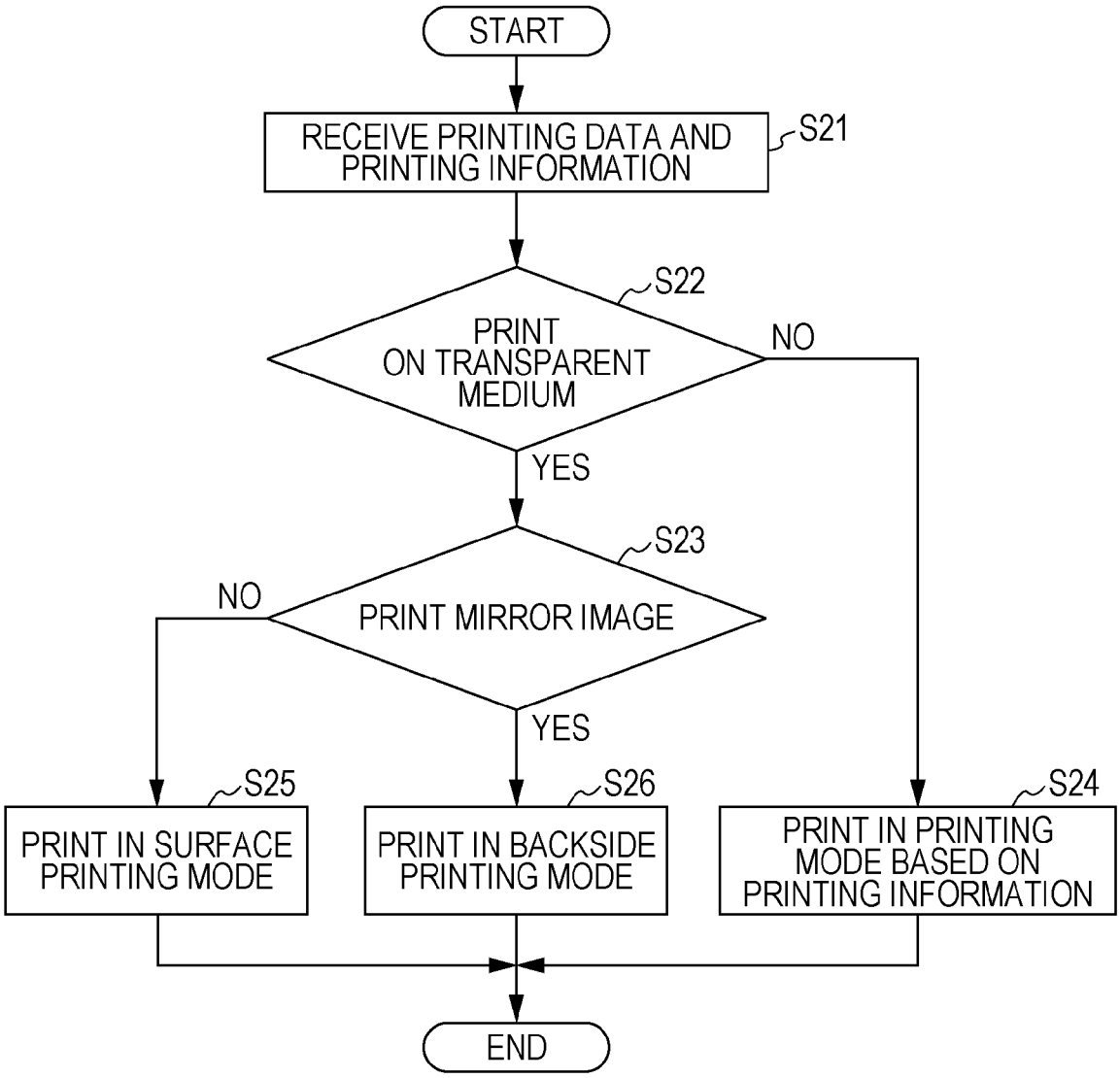
FIG. 16 is a view for explaining a modified example in processing in which a printer prints an image on a transparent medium.

FIG. 16 is a view for explaining a modified example in processing when the printer prints an image on a transparent medium.

In addition, this embodiment has been described with respect to an example in which the user selects a transparent medium as the medium and information related to whether to print an image to be seen through the transparent medium or an image to be seen directly is input. Alternatively, as shown in FIG. 16, when information related to printing a mirror image is input from the user, based on the input information (S23), the backside printing mode is executed by the printer 1 (S26).

Modified Example of First Exemplary Embodiment

The first exemplary embodiment has been described with respect to an example in which the overlapping interlace printing mode is set as the surface printing mode and the interlace printing mode without overlapping is set as the backside printing mode. Alternatively, the overlapping interlace printing mode can be set to both the surface printing mode and backside printing mode, and the number of nozzles, which eject ink to form dots of one raster line, in the surface printing mode can be set different from that in the backside printing mode. For example, the surface printing mode can be set to form one raster line by ejecting ink from four nozzles, and the backside printing mode can be set to form one raster line by ejecting ink from two nozzles as shown in FIG. 12. Even in this case, the background image is printed prior to the CMYK image in the surface printing mode, and the background image is printed after the CMYK image in the backside printing mode.

In addition, there may be a mode type in which one raster line is formed by moving a nozzle three times or more. In this case, for example, the mode in which one raster line is formed by moving a nozzle three times is set to move the nozzle more than the mode in which one raster line is formed by moving a nozzle two times.

In addition, the number of nozzles, which are used in practice in printing, can be less than the number of nozzles of the head. For example, in this embodiment, if the nozzle pitch of a head section is 360 dpi, when printing is performed with a resolution of 180 dpi in the intersecting direction, the printing can be performed using only half of all of the nozzles if the same drive frequency is given. In addition, since the dot intervals in the intersecting direction are twice, the moving speed of the carriage can be doubled if all of the nozzles are used at the same drive frequency.

Second Exemplary Embodiment

The second exemplary embodiment is an example in which the printing mode without overlapping is set for both the surface printing mode and the backside printing mode.

In the second exemplary embodiment, for example, the interlace printing mode without overlapping is set as the surface printing mode, and the band printing mode without overlapping is set as the backside printing mode.

When a printing operation is executed by the user as he/she designates the transparent film as a medium and selects an image, which is supposed to be seen directly, using the computer 80, the printer driver generates printing data for printing a positive image of the designated image, and printing information related to printing in the surface printing mode is given to the printing data, which is then sent to the printer 1.

When the printer 1 receives the printing data and the printing information, the controller 60 executes a printing program for printing a positive image in the interlace printing mode without overlapping, based on the printing information (S15).

Figure 14:
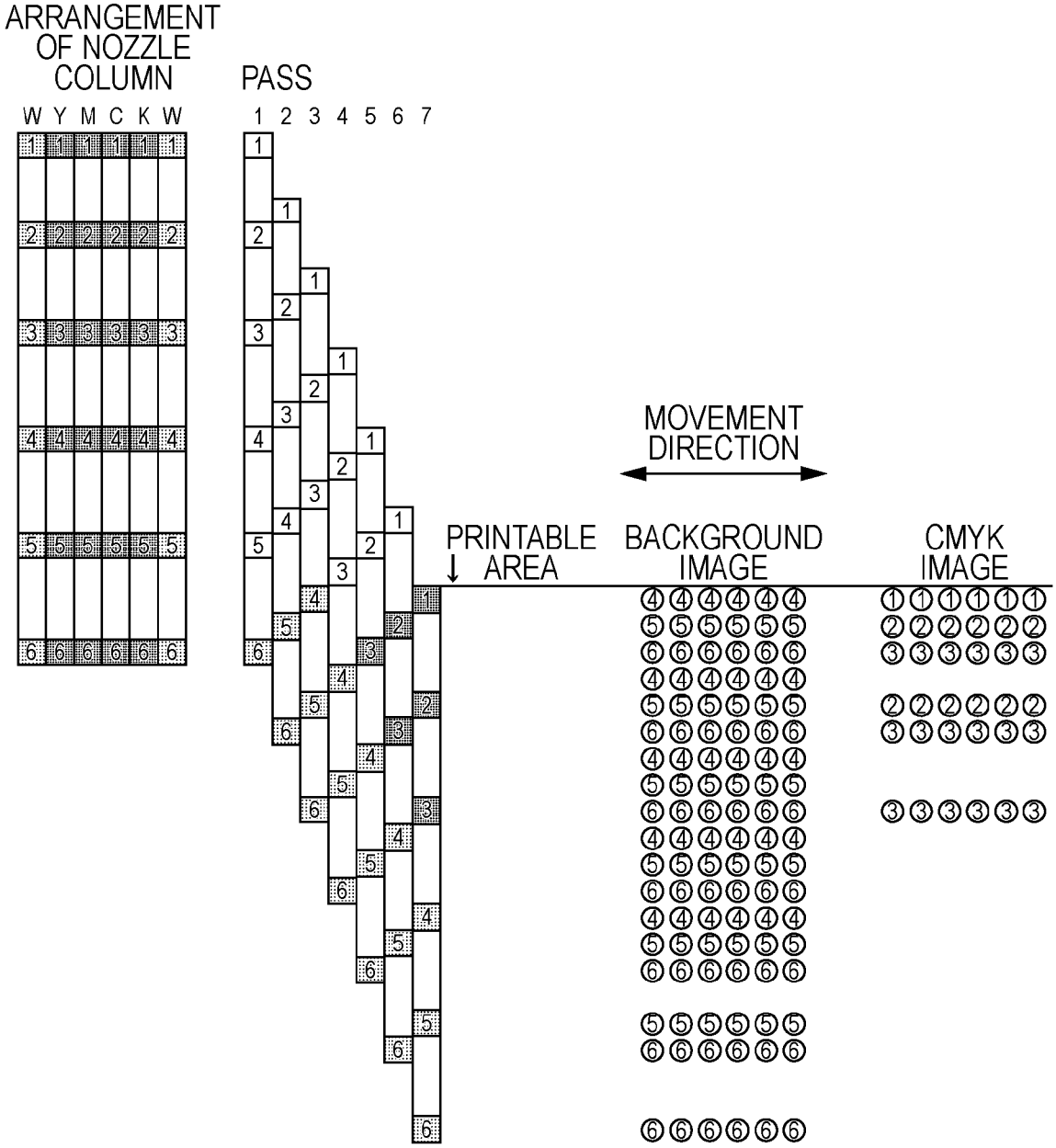
FIG. 14 is a view for explaining a transportation operation and a dot-forming operation as well as a configuration in which dots are formed in interlace printing mode without overlapping, which is executed as surface printing mode.

FIG. 14 is a view for explaining a transportation operation and a dot-forming operation as well as a configuration in which dots are formed in the interlace printing mode without overlapping, which is executed as the surface printing mode. Although FIG. 14 shows a CMYK image and a background image as being distinct from each other, the CMYK image is printed on the background image in practice.

The printer 1 prints the image by executing the transportation operation of a transparent film and the dot-forming operation as shown in FIG. 14. The interlace printing mode without overlapping shown in FIG. 14 is different from the interlace printing mode without overlapping, which is described above with reference to FIG. 13, in that the background image is printed using white ink before the CMYK image is printed.

In the example shown in FIG. 14, the background image is printed by ejecting white ink using upstream nozzles of the white ink nozzle row W, located adjacent to the leading end of the carriage 21 in the movement direction, up to four passes (i.e., two times of proceeding and two times of returning) so that the image printed on the transparent film looks the same as that printed on a sheet of white paper. From the fifth pass, the background image is printed by ejecting ink from upstream nozzles of the white ink nozzle row W, and respective components of the CMYK image are printed on the previously-printed background image using downstream nozzles of the ink nozzle rows of CMYK colors, located downstream in the transport direction.

In addition, when data of the image to be printed and information related to printing the image as an image to be seen through the transparent film are input from the computer 80 by the user, the printer driver generates printing data for printing a mirror image of the designated image, and printing information related to printing in the backside printing mode is given to the printing data, which is then sent to the printer 1.

When the printer 1 receives the printing data and the printing information, the controller 60 executes a printing program in the band printing mode without overlapping based on the printing information (S16).

Figure 15:
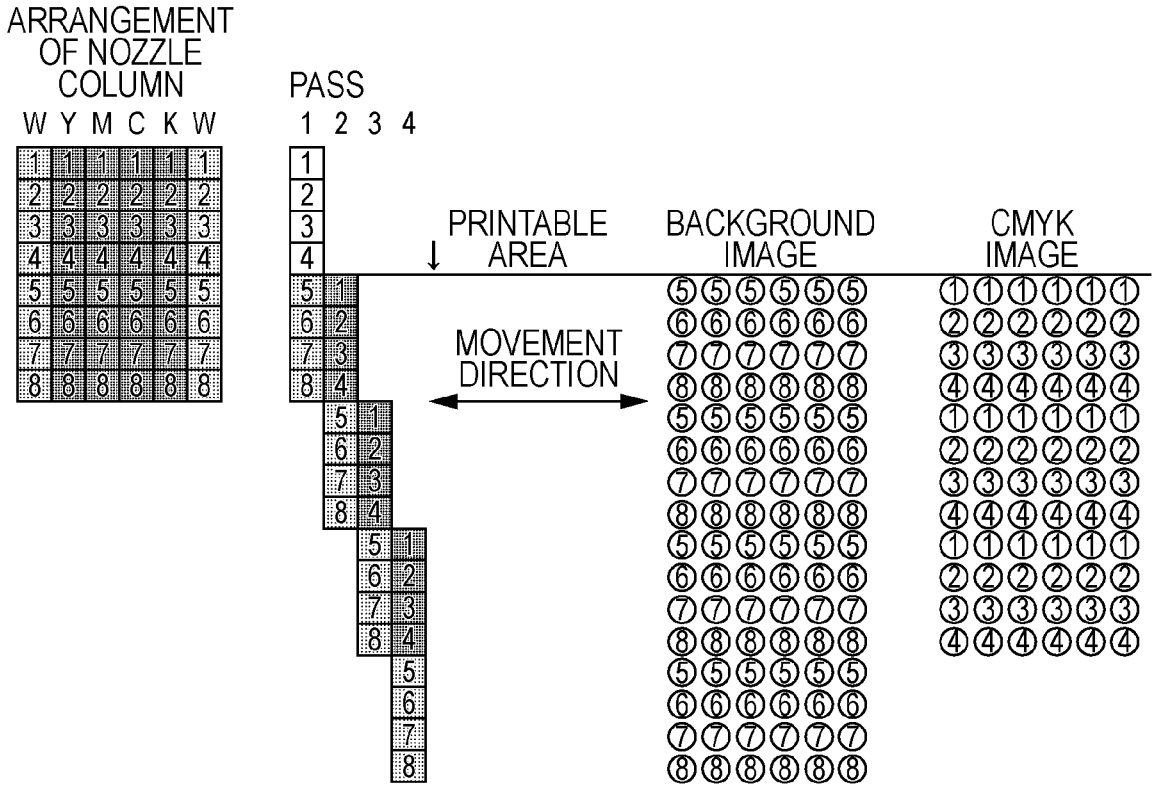
FIG. 15 is a view for explaining a transportation operation and a dot-forming operation as well as a configuration in which dots are formed in band printing mode without overlapping, which is executed as backside printing mode.

FIG. 15 is a view for explaining a transportation operation and a dot-forming operation as well as a configuration in which dots are formed in the band printing mode without overlapping, which is executed as the backside printing mode.

The printer 1 prints the image by executing the transportation operation of a transparent film and the dot-forming operation as shown in FIG. 15. The band printing mode without overlapping shown in FIG. 15 is different from the band printing mode without overlapping, which is described above with reference to FIG. 5, in that the background image is printed using white ink before the CMYK image is printed.

In the example shown in FIG. 15, respective components of the CMYK image are printed using upstream nozzles of the ink nozzle rows of respective CMYK colors, located upstream in the transport direction, in the first pass and, from the second pass, the background image is printed on all of the printing area by ejecting white ink using downstream nozzles of the white ink row W, located adjacent to the rear end of the carriage 21 in the movement direction, while the respective components of the CMYK image are being printed using the upstream nozzles of the ink nozzle rows of the ink nozzle rows of the CMYK colors so that the image printed on the transparent film looks the same as that printed on a sheet of white paper.

Third Exemplary Embodiment

The third exemplary embodiment is an example in which the printing mode without overlapping is set to both the surface printing mode and the backside printing mode. The surface printing mode is set to eject ink when the carriage moves in one direction (i.e., a predetermined direction), and the backside printing mode is set to eject ink when the carriage moves in the predetermined direction and when the carriage moves in the opposite direction. That is, Uni-d printing mode is set to the surface printing mode, and Bi-d printing mode is set to the backside printing mode.

In the third exemplary embodiment, a printing operation is executed by the user as he/she designates the transparent film as a medium and selects an image, which is supposed to be seen directly, using the computer 80, the printer driver generates printing data for printing a positive image of the designated image, and printing information related to printing in the surface printing mode is given to the printing data, which is then sent to the printer 1.

When the printer 1 receives the printing data and the printing information for printing the image to be seen directly, the controller 60 executes a printing program for printing the positive image in the Uni-d printing mode as the interlace printing mode without overlapping, based on the printing information (S15). While the image formed in the surface printing mode and the nozzles used in the third exemplary embodiment are the same as in FIG. 14, which shows the surface printing mode of the second exemplary embodiment, except for the movement operation of the carriage 21 in the transportation operation of the transparent film and the dot-forming operation. Specifically, while the surface printing mode of the second exemplary embodiment is set to perform the transportation operation of transporting the medium whenever the carriage proceeds and returns, the surface printing mode of the third exemplary embodiment is set to perform the transportation operation of transporting the medium after the carriage 21 is reciprocally moved, that is, proceeded and returned.

In addition, when the printer 1 receives the printing data and the printing information for printing the image to be seen through the medium, the controller 60 executes a printing program to print a mirror image in the interlace printing mode without overlapping, particularly, in the Bi-d printing mode based on the printing information (S16). The transportation operation of the transparent film and the dot-forming operation in the backside printing mode of the third exemplary embodiment are the same as in FIG. 13, which shows the backside printing mode of the first exemplary embodiment.

Fourth Exemplary Embodiment

Figure 17A:
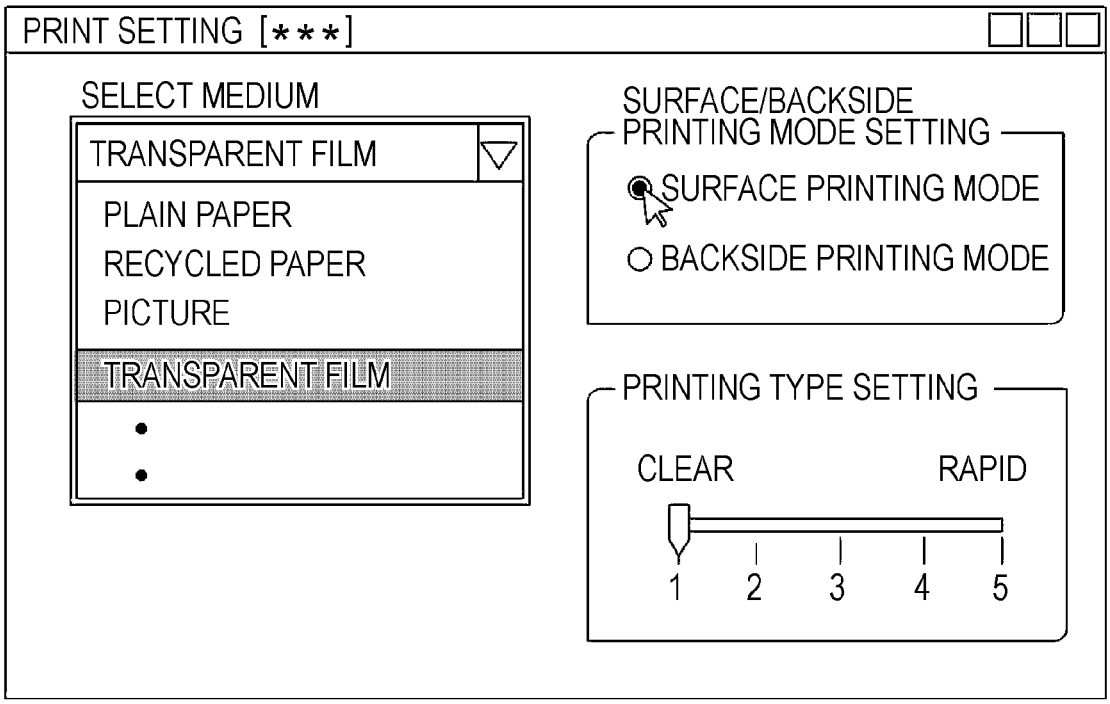
FIG. 17A is a view schematically showing a UI screen in the case of selecting surface printing mode.
Figure 17B:
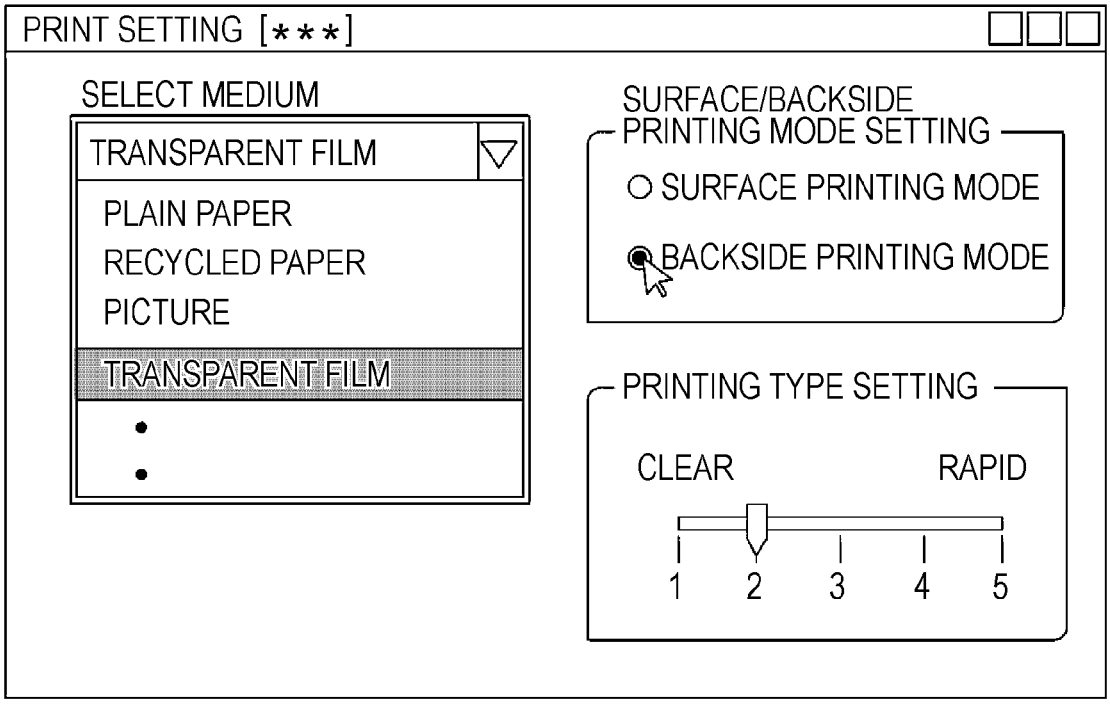
FIG. 17B is a view schematically showing a UI screen in the case of selecting backside printing mode.

The fourth exemplary embodiment provides a printer in which the user can select by himself/herself to switch between the surface printing mode and the backside printing mode using the printer driver. FIGS. 17A and 17B are schematic views each showing a User Interface (hereinafter, referred to as UI) screen, which is used when the user selects respective modes in practice. In this exemplary embodiment, the UI screen is displayed on a display device or the like of the computer 80. It is possible to set the type of the medium, printing mode, and printing type on the UI screen. As the type of the medium, "plain paper" and "picture paper" as well as "transparent film" can be selected. As a printing mode, "surface printing mode" or "backside printing mode" can be selected. The user makes a variety of selections using an indicator such as a mouse on the UI screen.

The printer driver stores a plurality of printing types in which the transportation operation of the medium and the dot-forming operation are combined appropriately in consideration of the beauty and speed of the printing such as the band printing, interlace printing, Uni-d printing, and Bi-d printing, which have been described above. An optimal printing type is set as default to each mode of the surface printing and the backside printing. When the user selects the surface printing mode or the backside printing mode on the UI screen, the printing type is switched depending on the section and is then displayed on the UI screen. For example, FIG. 17A shows the configuration of the UI screen when the surface printing mode is selected, and FIG. 17B shows the configuration of the UI screen when the backside printing mode is selected. In this exemplary embodiment, if the user selects the surface printing mode, printing type 1 is set as default (FIG. 17A). If the user selects the backside printing mode, printing type 2 is set (FIG. 17B). In addition, although five types of printing types 1 to 5 are shown in FIGS. 17A and 17B, the number of the printing types is not limited to five but can be more or less.

FIG. 18 is a view showing an example of the printing type set in the printer driver in the fourth exemplary embodiment. In addition, it can be assumed that the nozzle pitch of the head is set to 360 dpi. Items set as the printing type may include printing resolution, paper feed type (i.e., band, pseudo band, and interlace), selection whether or not to perform overlapping printing, printing direction (i.e., Uni-d printing and Bi-d printing), and the like. The beauty and printing speed of the image to be formed are determined by combining these items. The printing types 1 to 5 are set in FIG. 18. For example, the printing type 1 is a mode in which the printing quality is considered to be most important so that a clear image can be printed. As the number of the printing type increases, the printing speed is considered to be more important than the printing quality. The printing type 5 is a mode in which the printing speed is considered to be most important so that an image can be printed rapidly.

As described above, when the user selects the surface printing mode, the printing type 1 is set as default. As shown in FIG. 18, the printing type 1 is set as a printing type in which an image can be printed as clearly as possible since resolution is set to 1440×720 dpi, the paper feed type is set to interlace type, overlapping printing is enabled, and the printing direction is Uni-d. The surface printing mode is set by considering the printing quality important, so that stains or the like can rarely occur on the surface of the printed image since the printed surface is seen directly from the surface of the medium.

In addition, when the user selects the backside printing mode, the printing type 2 is set as default. The printing type 2 is set as a printing type in which the printing speed is considered to be more important than in the printing type 1. In the printing type 2, as shown in FIG. 18, resolution is 720×720 dpi, which is less than that of the printing type 1, and the printing direction is Bi-d. Since it is assumed that the image formed is seen from the backside of the transparent medium, it is not necessary for the backside printing mode to take account of the surface status (i.e., quality) of the printed image when compared to the surface printing mode, and thus the fast printing speed is set.

In addition, although the above-described printing types are set as default, it is possible for the user to change the printing type on the UI screen by himself/herself. For example, when the surface printing mode is selected, although the printing type 1 shown in FIG. 18 is set as default (see FIG. 17A), it is possible to change the printing type 1 into the printing type 5 (i.e., a mode in which the printing speed is considered to be most important). When the backside printing mode is selected, it is possible to change the printing type 2 set as default (see FIG. 17B) into the printing type 1 (i.e., a mode in which the printing quality is considered to be most important).

Figure 19A:
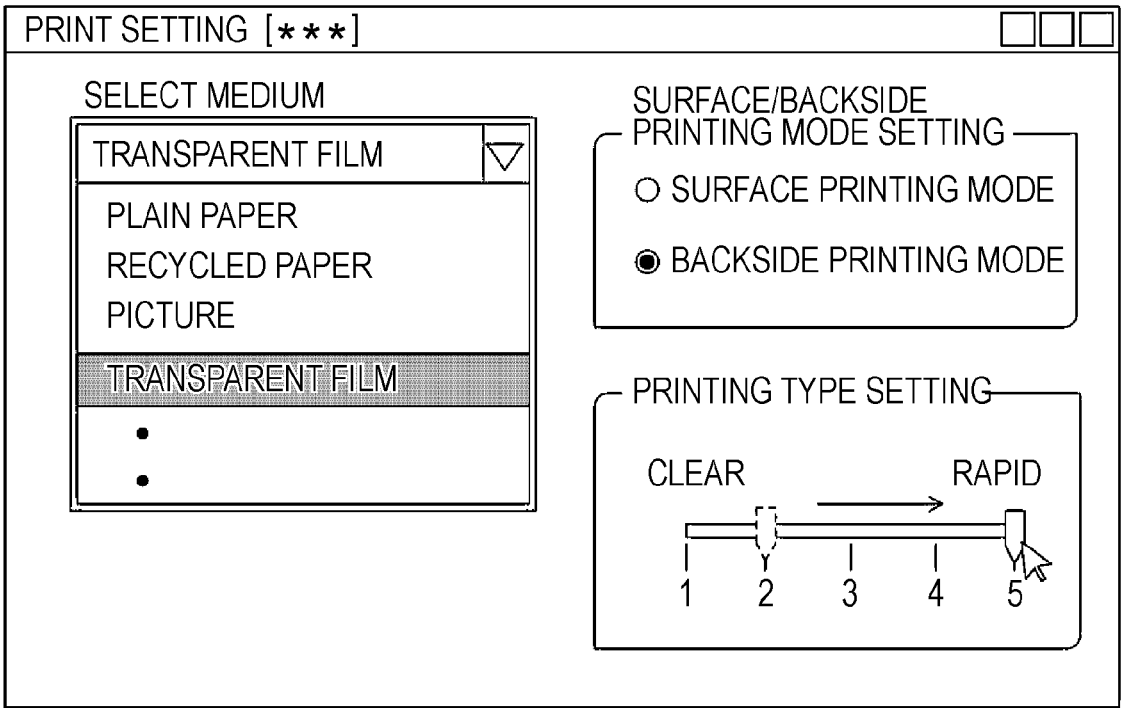
FIG. 19A is a view schematically showing a UI screen when a user changes printing type into printing type 5 when backside printing mode is selected.
Figure 19B:
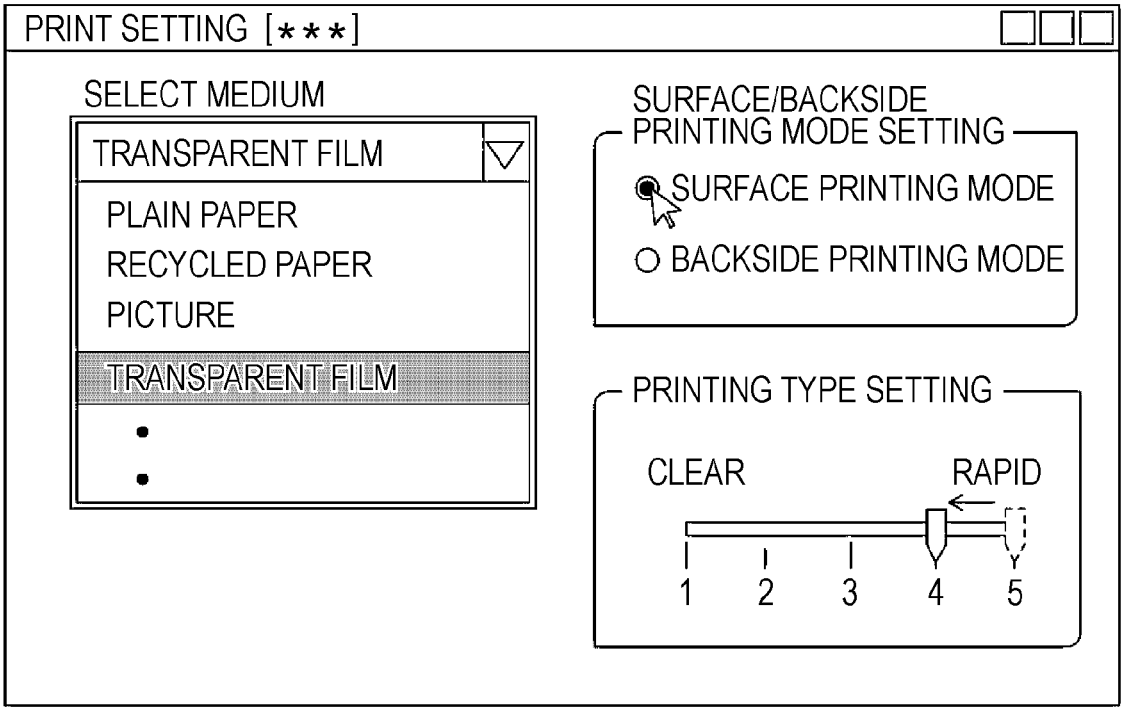
FIG. 19B is a view schematically showing the UI screen when the backside printing mode is switched into surface printing mode in the state shown in FIG. 19A.

In addition, when the user changes the printing type set as default, the change can be stored in the printer driver. When the surface/backside printing mode is changed after the change of the printing type, the change is also reflected. That is, when the surface/backside printing mode is changed, the printing type of the surface printing mode is set to one-level clearer type (i.e., a printing type having a one-level smaller number) when compared to the printing type 1 in the latest backside printing mode. For example, in the case of selecting the backside printing mode as shown in FIG. 19A, when the user changes the printing type 2 set as default into the printing type 5, the printer driver stores the changed printing type. When the user switches the backside printing mode into the surface printing mode, the printing type 4, which is one-level clearer than the printing type 5, is selected as shown in FIG. 19B. Although the default of the surface printing mode is the printing type 1, the printing can be performed by reflecting more the preference of the user, based on the latest setting of the user (i.e., the printing type 5). On the contrary, when the surface printing mode is switched into the backside printing mode, the printing type is set to one-level faster type (i.e., a printing type having a one-level greater number).

In addition, when intended additionally to change the printing type, which is set as above, the user can make a change on the UI screen.

Modified Example of Fourth Exemplary Embodiment

Figure 20:
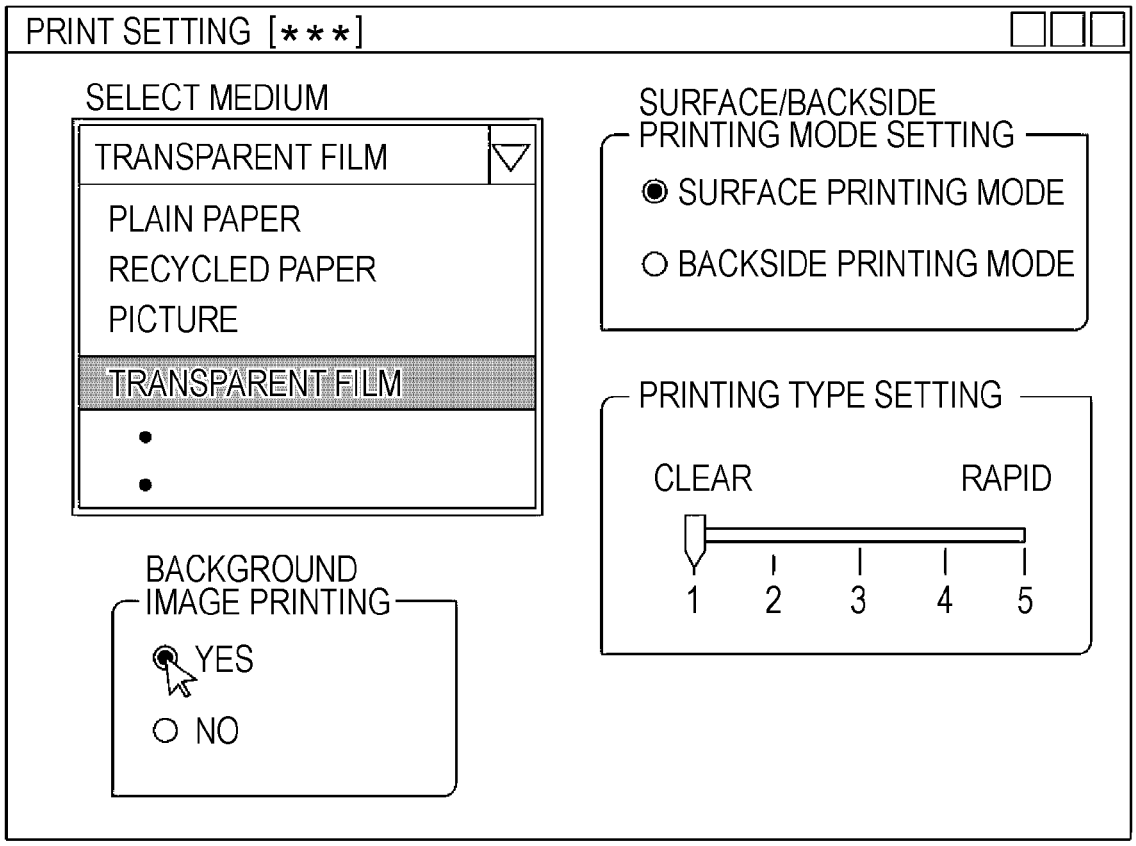
FIG. 20 is a view schematically showing a UI screen having a background printing-selecting menu.

FIG. 20 schematically shows a UI screen used in the modified example of the fourth exemplary embodiment. The UI screen shown in FIG. 20 displays a menu selecting a background image-selecting menu so that the user can set by himself/herself whether or not to form a background image in the printing.

As described above, an image printed on a transparent medium looks the same as the image printed on a sheet of white paper due to the background image formed on the medium.

In addition, when the printing is performed on the transparent medium, it is possible not to form the background image by operating the UI screen. When the background image is not formed, the printing can be performed faster since the number of usable color nozzles increases. For example, in the case of performing the printing as shown in FIG. 12, white ink is ejected to form the background image through passes 1 to 8. However, if the background image is not necessary, it is possible to eject color inks using the color nozzles through passes 1 to 8, thereby reducing a time period spent before the completion of the printing. On the contrary, background color can be formed when the printing is performed on a sheet of plain paper.

In addition, although the background image is basically formed in white, an item for setting the background color can be provided on the UI screen so that the background color can be changed into another color such as black or gray if necessary. In this exemplary embodiment, default is set to form a white background image when the user selects the transparent film as a medium, and default is to form no background image when the user selects the plain paper as a medium.

Fifth Exemplary Embodiment

In the fifth exemplary embodiment, as in the fourth exemplary embodiment, the user can switch by himself/herself the surface printing mode into the backside printing mode and vice versa using the UI screen shown in FIG. 17A. In addition, unlike the fourth exemplary embodiment, the user can select the printing type by himself/herself. Even if the printing type is the same, when the surface printing mode is selected, resolution, printing direction, or the like is set different from when the backside printing mode is selected.

FIG. 21 is a view showing an example of the printing mode set in the printer driver in the fifth exemplary embodiment of the invention. Five printing types are set to each of the surface printing mode and the backside printing mode, and are set differently from each other. As in the fourth exemplary embodiment, the printing type 1 is a mode in which printing quality is considered to be most important. As the number of the printing type increases, the printing speed is considered to be more important than the printing quality. When the number of the printing type of the surface printing mode is the same as that of the printing type of the backside printing mode, the surface printing mode is set as considering the printing quality to be more important whereas the backside printing mode is set as considering the printing speed to be more important. This is because the direction of viewing the printed surface in the surface printing mode is different from that in the backside printing mode as described above, and because the image looks different due to influences such as the reflection of light.

For example, in the printing type 1, the printing direction of the surface printing mode is Uni-d whereas the printing direction of the backside printing mode is Bi-d. A variety of settings other than the printing direction in the surface printing mode is the same as in the backside printing mode. These are the same settings as described above in the third exemplary embodiment. In the surface printing mode, the movement direction of the carriage is maintained constant when ejecting ink so that a clearer image can be printed than in the backside printing mode.

In the printing type 2, the surface printing mode performs overlapping printing whereas the backside printing mode does not perform overlapping printing. A variety of settings other than the overlapping printing are the same both in the surface printing mode and in the backside printing mode. These are the same settings as described above in the first exemplary embodiment. The surface printing mode can suppress concentration stains due to a difference in the ink ejecting characteristics of the nozzles by performing the overlapping printing, thereby printing a clearer image than the backside printing mode.

In the printing type 3, as in the printing type 1, the surface printing mode is Uni-d printing whereas the backside printing mode is Bi-d printing, and the surface printing mode can print a clearer image. However, the resolution and paper feed type of the printing type 3 are set to a level lower than those of the printing type 1. In general, printing speed is considered to be more important when compared to the printing type 1.

Both in the printing types 4 and 5, the resolution of the surface printing mode is set higher than that of the backside printing mode so that the surface printing mode can print a clearer image than the backside printing mode.

The user selects the surface printing mode or the backside printing mode on the UI screen, and then selects a printing type (i.e., one of the printing types 1 to 5 in the fifth exemplary embodiment). The printer driver determines a printing type corresponding to the surface printing mode or the backside printing mode based on the matrix shown in FIG. 21, and the printing is performed according to the printing type determined.

CONCLUSION

According to the printing system 100 of the foregoing exemplary embodiments, in the backside printing mode that is a printing mode for printing an image to be seen through a transparent film, on the transparent film and a printing mode for printing a mirror image on the transparent film, and in the surface printing mode that is a printing mode for printing an image to be seen directly and a printing mode for printing a positive image on a medium, one or both of the transportation operation and the dot-forming operation are different. In the case of printing the image to be seen through the transparent film or the mirror image on the transparent film and in the case of printing the image to be seen directly or the positive image on the transparent film, the printing can be performed by the proper transportation operation and the proper dot-forming operation. Accordingly, both in the case of printing the image to be seen through the transparent film or the mirror image on the transparent film and in the case of printing the image to be seen directly or the positive image on the transparent film, it is possible to print an image more rapidly from which stripe patterns occurring due to color stains or the like are not easily seen.

In particular, in the case of printing an image on a medium such as paper and seeing the printed image from the printed surface, the stripe-like concentration stains are easily seen due to scattered reflection. However, in the case of seeing an image, which is printed on a transparent film, through the transparent film, scattered reflection does not occur due to high smoothness of the surface since the surface is a film surface, and thus the stripe-like concentration stains are not easily seen. Therefore, as in the first exemplary embodiment, the dot-forming operation of the surface printing mode has a greater number of the passes of the nozzles to form one raster line, which is lined up in the intersecting direction, than the dot-forming operation of the backside printing mode, so that the surface printing mode can form an image in which the concentration stains are not easily seen.

In addition, the concentration stains are easily seen when the image printed in the backside printing mode is seen directly. However, the concentration stains are not easily seen when the printed image is seen as a positive image through the transparent film. Therefore, in the case of printing a mirror image to form an image to be seen through the transparent film, it is possible to reduce the number of the passes of the nozzles to form one raster line, thereby printing the image more rapidly.

In particular, as in the first to third embodiments, it is possible to print an image more rapidly by forming one raster line of an image printed in the backside printing mode, in which concentration stains are not easily seen due to seeing through the medium, by one pass of the nozzle.

In addition, as shown in the second exemplary embodiment, it is possible to print an image, in which concentration stains are not easily seen, by forming a raster line of an image printed in the surface printing mode, in which an image to be seen directly is printed, so as to have smaller intervals in the transport direction than that of an image printed in the backside printing mode, in which an image to be seen through the transparent film is printed.

In addition, as in the third exemplary embodiment, when the nozzle is moved in the same direction when ejecting ink to form a raster line, precision in the positions of the dots of an image, which is printed in the surface printing mode, is higher than in the case of ejecting ink both in the proceeding and returning of the nozzle in the backside printing mode. As a result, it is possible to print a better image.

Meanwhile, in the image printed in the backside printing mode, the nozzle moves in alternating directions when ejecting ink to form a raster line. Accordingly, in the case of printing an image to be seen through the transparent film, it is possible to print more rapidly the image, in which concentration stains are not easily seen.

In addition, as in the first exemplary embodiment, in the dot-forming operation of the surface printing mode, the number of the nozzles, which eject ink to form a raster line, in which dots are arranged in the intersecting direction, is increased to be greater than that in the dot-forming operation of the backside printing mode. As a result, it is possible to form an image, in which concentration stains are not easily seen. In addition, concentration stains are easily seen in an image printed in the backside printing mode when the image is seen directly. However, since the image printed on the transparent film is an image to be seen through the transparent film or a mirror image, when the image is seen through the transparent film, the concentration stains are not easily seen. Accordingly, in the case of printing an image to be seen through the transparent film or a mirror image, it is possible to print the image more rapidly by reducing the number of nozzles that form one raster line.

In particular, as in the first exemplary embodiment, one raster line of the image printed in the backside printing mode, in which the concentration stains are not easily seen due to seeing through the medium, is formed using one nozzle, it is possible to print the image more rapidly.

In addition, in the backside printing mode, after an image is printed, a background image serving as the background of the image is printed. Even if the image is printed on the transparent film, the printing area does not have a transparent portion through which an object beyond the transparent film can be seen since the image is printed on the background image when the image is seen through the transparent film. Accordingly, it is possible to print a clear image.

In addition, in the surface printing mode, before an image is printed, a background image serving as the background of the image is printed. Even if the image is printed on the transparent film, the printing area does not have a transparent portion through which an object beyond the transparent film can be seen since the image is printed on the background when the image is seen directly. Accordingly, it is possible to print a clear image.

In addition, since the background image is printed by ejecting white ink on all of the printing area, the image printed on the transparent film looks the same as the image if printed on a sheet of white paper.

In addition, as in the fourth exemplary embodiment, the user can be allowed to select the surface printing mode or the backside printing mode by himself/herself by operating the UI screen and a predetermined type of printing can be set by combining the dot-forming operation and the medium transportation operation based on the selection.

In addition, the user can change a variety of printing types, which are defined as above, by himself/herself.

In addition, as in the fifth exemplary embodiment, the user can be allowed to select the surface printing mode or the backside printing mode by himself/herself by operating the UI screen and select a printing type for the selected printing mode, so that the respective printing modes can have different dot-forming operations or medium transportation operations. Thereby, the user can freely determine a selection on whether to print a fine image or to print an image more rapidly.

Other Embodiments

Although the printer or the like has been described as a certain exemplary embodiment, this been presented for the sake of understanding of the present invention but is not intended to limit the invention. It is apparent that the invention can be modified and reformed without departing from the spirit of the invention, which of course includes equivalents. In particular, the scope of the invention also includes the following embodiments which will be described later.

About the Printing System

In the foregoing embodiment, the printing system 100 has been described as including the printer 1 and the computer, which is connected to the printer 1 so as to communicate therewith. However, the present invention is not limited thereto. For example, the printing system 100 can be implemented with a printer, which includes an interface associated with memory or the like and an input operation section, and which can print an image when image data of the memory or the like are designated by an operation from the input operation section.

About the Nozzle

In the foregoing embodiment, ink is ejected using the piezoelectric device. However, the method of ejecting ink is not limited thereto. For example, a method of generating bubbles in the nozzle by heating can be used.

About the Ink

In the foregoing embodiment, UV ink, which cures in response to UV radiation, is ejected from the nozzle. However, liquid ejected from the nozzle is not limited thereto. Rather, the nozzle can eject another type of liquid, which cures when radiated by electromagnetic waves (e.g., visible light) rather than the UV rays. In this case, the pre-curing radiation sections 41*a* and 41*b* and the main curing radiation section 43 are constructed to radiate electromagnetic waves (e.g., visible light) to cure the liquid.

Furthermore, it is also possible to use so-called water-based ink, which fixes through deposition and permeation into the medium, rather than the ink that cures in response to UV radiation or the like as described above. For example, in the case of printing a positive image on a sheet of plain paper as a medium, it is possible to print the image using dye ink or pigment ink, which is generally used at home.

What is claimed is:

1. A printing apparatus for printing an image on a transparent medium, which is transported in a transport direction, by forming dots by ejecting ink from a plurality of nozzles while moving the nozzles in an intersecting direction that intersects the transport direction, the printing apparatus comprising:

a printing apparatus controller that allows a user to select whether to print the image on the medium as an image to be seen through the medium or as an image to be seen directly, wherein the printing apparatus controller displays a printing mode-selecting section which selects a printing mode on a user interface screen, the printing mode-selecting section allowing the user to select whether the image will be seen through the medium or directly, wherein a first printing type is displayed on the user interface screen when the user selects that the image will be seen through the medium, the first printing type defining a transportation operation of transporting the medium and a dot-forming operation of forming the dots by ejecting ink while moving the nozzles, and wherein a second printing type is displayed on the user interface screen when the user selects that the image will be seen directly, the second printing type being different from the first printing type in at least one of the transportation operation and the dot-forming operation.

2. The printing apparatus according to claim 1, wherein the first printing type is superior to the second printing type in image-forming speed, and wherein the second printing type is superior to the first printing type in quality of the image to be formed.

3. The printing apparatus according to claim 1, wherein the printing apparatus further allows the user to change the printing type on the user interface screen after the first or second printing type is displayed on the user interface screen.

4. The printing apparatus according to claim 1 wherein the printing mode-selecting section selects a first printing mode when the image will be been through the medium and a second printing mode when the image will be seen directly, wherein the printing apparatus controller further displays a printing type-selecting section, which selects the first or the second printing type, on the user interface screen, and wherein the first printing type when the first printing mode is selected is different from the first printing type when the second printing mode is selected in at least one of the transportation operation and the dot-forming operation.

5. The printing apparatus according to claim 4, wherein the first printing type is superior to the second printing type in image-forming speed and the second printing type is superior to the first printing type in quality of the image to be formed when the first and second printing types belong to the same printing mode, and wherein the first printing mode is superior to the second printing mode in image-forming speed and the second printing mode is superior to the first printing mode in quality of the image to be formed when the first and second printing modes have the same printing type.

* * * * *